US010836981B2

(12) United States Patent
Panandiker et al.

(10) Patent No.: US 10,836,981 B2
(45) Date of Patent: Nov. 17, 2020

(54) ANTI-FOAM COMPOSITIONS COMPRISING AN ORGANOPOLYSILOXANE WITH ADJACENT HYDROLYSABLE GROUPS

(71) Applicant: The Procter & Gamble Company, Cincinnati, OH (US)

(72) Inventors: Rajan Keshav Panandiker, West Chester, OH (US); Bernard William Kluesener, Harrison, OH (US); Rachel Morgan Clayton Roeder, Mason, OH (US); Hiroyuki Moriya, Gunma-Ken (JP); Shinji Irifune, Gunma (JP)

(73) Assignee: The Procter & Gamble Company, Cincinnati, OH (US)

( * ) Notice: Subject to any disclaimer, the term of this patent is extended or adjusted under 35 U.S.C. 154(b) by 69 days.

(21) Appl. No.: 15/808,916

(22) Filed: Nov. 10, 2017

(65) Prior Publication Data

US 2019/0144783 A1 May 16, 2019

(51) Int. Cl.

| | |
|---|---|
| ***C11D 9/36*** | (2006.01) |
| ***C11D 3/00*** | (2006.01) |
| ***C11D 3/37*** | (2006.01) |
| ***C11D 1/86*** | (2006.01) |
| *C11D 1/14* | (2006.01) |
| *C11D 1/22* | (2006.01) |
| *C11D 1/29* | (2006.01) |
| *C11D 1/62* | (2006.01) |
| *C11D 1/72* | (2006.01) |

(52) U.S. Cl.

CPC ..... *C11D 3/0026* (2013.01); *C11D 1/86* (2013.01); *C11D 3/001* (2013.01); *C11D 3/0036* (2013.01); *C11D 3/373* (2013.01); *C11D 3/3738* (2013.01); *C11D 1/146* (2013.01); *C11D 1/22* (2013.01); *C11D 1/29* (2013.01); *C11D 1/62* (2013.01); *C11D 1/72* (2013.01)

(58) Field of Classification Search

CPC ..... C11D 9/36; C11D 1/82; C11D 3/0026; C11D 3/124; C11D 3/162; C11D 3/373

See application file for complete search history.

(56) References Cited

U.S. PATENT DOCUMENTS

| | | | | |
|---|---|---|---|---|
| 4,137,180 | A | 1/1979 | Naik et al. | |
| 5,486,306 | A * | 1/1996 | L'Hostis | B01D 19/0409 510/228 |
| 6,521,587 | B1 * | 2/2003 | L'Hostis | B01D 19/0404 510/347 |
| 2004/0116316 | A1 * | 6/2004 | Michel | B01J 2/006 510/444 |
| 2007/0112078 | A1 * | 5/2007 | Procter | B01D 19/0409 516/117 |
| 2007/0275866 | A1 | 11/2007 | Dykstra | |
| 2011/0294714 | A1 * | 12/2011 | Delbrassinne | B01D 19/0404 510/343 |
| 2014/0289969 | A1 * | 10/2014 | Sadlowski | C11D 1/29 8/137 |
| 2015/0141561 | A1 * | 5/2015 | Kennoki | B01D 19/0409 524/266 |
| 2016/0090552 | A1 * | 3/2016 | Loughnane | C11D 3/0036 510/300 |
| 2017/0275566 | A1 * | 9/2017 | Scialla | C11D 1/22 |

FOREIGN PATENT DOCUMENTS

WO 0105874 A1 1/2001

* cited by examiner

*Primary Examiner* — Charles I Boyer

(74) *Attorney, Agent, or Firm* — Andres E. Velarde; James F. McBride

(57) ABSTRACT

The present application relates to anti-foam compositions and methods of making and using such compositions as well as consumer products that comprise such compositions and the use of same. Such anti-foam compositions have low viscosities yet are effective antifoamers.

14 Claims, No Drawings

ANTI-FOAM COMPOSITIONS COMPRISING AN ORGANOPOLYSILOXANE WITH ADJACENT HYDROLYSABLE GROUPS

FIELD OF THE INVENTION

The present application relates to anti-foam compositions and methods of making and using such compositions as well as consumer products that comprise such compositions and the use of same.

BACKGROUND OF THE INVENTION

Cleaning and/or treatment compositions may employ materials that produce suds. In certain cleaning and/or treatment compositions, the level of suds is higher than desired. One manner of reducing suds is to add an antifoam to the cleaning and/or treatment composition. While anti-foam compositions that comprise high viscosity silicones are highly effective, such compositions must be emulsified before they are incorporated into a consumer product such as a cleaning and/or treatment composition. To avoid the emulsification step, low viscosity silicones have been employed in anti-foam compositions. Unfortunately, such antifoam compositions are not very effective as antifoams. Furthermore, the effectiveness of such low viscosity anti-foams is compromised by detergent ingredients to the point that the antifoams are rendered ineffective. Such detergent ingredients include solvents polymers and perfumes. While not being bound by the theory, Applicants believe the problems associated with such ingredients arise as such ingredients penetrate the antifoam droplets and cause the antifoams components to separate. Applicants recognized that such separation could be mitigated by covalently bonding the antifoam components together before incorporating them in the cleaning and treatment composition. While not being bound by theory, Applicants believe that such anti-foam components react such that Si—O—Si groups are formed from the reaction of Si—OH and/or Si—OR groups on one antifoam component with another antifoam component's Si—OH and/or Si—OR groups wherein R is a methyl, ethyl, or propyl group and certain Si—O—Si groups already present before such reactions break and reform in a more preferred order thus yielding the superior antifoam. Such covalently bonded antifoam materials and compositions comprising same are disclosed herein.

SUMMARY OF THE INVENTION

The present application relates to anti-foam compositions and methods of making and using such compositions as well as consumer products that comprise such compositions and the use of same. Such anti-foam compositions have low viscosities yet are effective antifoamers.

DETAILED DESCRIPTION OF THE INVENTION

Definitions

As used herein "consumer product" means baby care, beauty care, fabric & home care, family care, feminine care, health care, snack and/or beverage products or devices intended to be used or consumed in the form in which it is sold, and not intended for subsequent commercial manufacture or modification. Such products include but are not limited to diapers, bibs, wipes; products for and/or methods relating to treating hair (human, dog, and/or cat), including, bleaching, coloring, dyeing, conditioning, shampooing, styling; deodorants and antiperspirants; personal cleansing; cosmetics; skin care including application of creams, lotions, and other topically applied products for consumer use; and shaving products, products for and/or methods relating to treating fabrics, hard surfaces and any other surfaces in the area of fabric and home care, including: air care, car care, dishwashing, fabric conditioning (including softening), laundry detergency, laundry and rinse additive and/or care, hard surface cleaning and/or treatment, and other cleaning for consumer or institutional use; products and/or methods relating to bath tissue, facial tissue, paper handkerchiefs, and/or paper towels; products and/or methods relating to oral care including toothpastes, tooth gels, tooth rinses, denture adhesives, tooth whitening; over-the-counter health care including pain relievers, pet health and nutrition, and water purification.

As used herein, the term "cleaning and/or treatment composition" includes, unless otherwise indicated, unit dose, granular or powder-form all-purpose or "heavy-duty" washing agents, especially cleaning detergents; liquid, gel or paste-form all-purpose washing agents, especially the so-called heavy-duty liquid types; liquid fine-fabric detergents; hand dishwashing agents or light duty dishwashing agents, especially those of the high-foaming type; machine dishwashing agents, including the various tablet, granular, liquid and rinse-aid types for household and institutional use; liquid cleaning and disinfecting agents, including antibacterial hand-wash types, cleaning bars, mouthwashes, denture cleaners, dentifrice, car or carpet shampoos, bathroom cleaners; hair shampoos and hair-rinses; shower gels and foam baths and metal cleaners; as well as cleaning auxiliaries such as bleach additives and "stain-stick" or pre-treat types, substrate-laden products such as dryer added sheets, dry and wetted wipes and pads, nonwoven substrates, and sponges; as well as sprays and mists.

As used herein, the term "fabric care composition" includes, unless otherwise indicated, fabric softening compositions, fabric enhancing compositions, fabric freshening compositions and combinations thereof.

As used herein, the articles "a" and "an" when used in a claim, are understood to mean one or more of what is claimed or described.

As used herein, the terms "include", "includes" and "including" are meant to be synonymous with the phrase "including but not limited to".

As used herein, the term "solid" means granular, powder, bar and tablet product forms.

As used herein, the term "situs" includes paper products, fabrics, garments, hard surfaces, hair and skin.

As used to describe and/or recite the organomodified silicone element of the antifoams and consumer products comprising same herein, a 2-phenylpropylmethyl moiety is synonymous with: (methyl)(2-phenylpropyl); (2-Phenylpropyl)methyl; methyl(2-phenylpropyl); methyl(β-methylphenethyl); 2-phenylpropylmethyl; 2-phenylpropylMethyl; methyl 2-phenylpropyl; and Me 2-phenylpropyl. Thus, organomodified silicones can, by way of example, use such nomenclature as follows:

(methyl)(2-phenylpropyl)siloxane
(methyl)(2-phenylpropyl) siloxane
(2-Phenylpropyl)methylsiloxane
(2-Phenylpropyl)methyl siloxane
methyl(2-phenylpropyl)siloxane
methyl(2-phenylpropyl) siloxane
methyl(β-methylphenethyl)siloxane methyl(β-methylphenethyl) siloxane
2-phenylpropylmethylsiloxane
2-phenylpropylmethyl siloxane
2-phenylpropylMethylsiloxane
2-phenylpropylMethyl siloxane
methyl 2-phenylpropylsiloxane
methyl 2-phenylpropyl siloxane
Me 2-phenylpropylsiloxane
Me 2-phenylpropyl siloxane.

As used herein, the nomenclature $SiO_{4-n/2}$ represents the ratio of oxygen and silicon atoms. For example, $SiO_{1/2}$ means that one oxygen is shared between two Si atoms. Likewise, $SiO_{2/2}$ means that two oxygen atoms are shared between two Si atoms and $SiO_{3/2}$ means that three oxygen atoms are shared are shared between two Si atoms and $SiO_{4/2}$ means that four oxygen atoms are shared are shared between two Si atoms.

As used herein, the term heteroatom takes it ordinary, customary meaning and thus includes N, O, S, P, Cl, Br, and I.

Unless otherwise noted, all component or composition levels are in reference to the active portion of that component or composition, and are exclusive of impurities, for example, residual solvents or by-products, which may be present in commercially available sources of such components or compositions.

All percentages and ratios are calculated by weight unless otherwise indicated. All percentages and ratios are calculated based on the total composition unless otherwise indicated.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Laundry Detergent and/or Fabric Enhancer Comprising Antifoams

A. A composition comprising an adjunct ingredient and an antifoam, said antifoam comprising:

a) an organopolysiloxane comprising at least one hydrolysable group of formula (1) said at least one hydrolysable group being bound to least one silicon atom of said organopolysiloxane segment composed of the main chain and said main chain containing a siloxy unit of formula (2) in an amount of at least 10 mole % based on weight of the said organopolysiloxane, preferably 10 mole % to 40 mole % based on weight of the said organopolysiloxane;

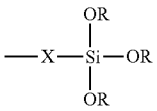

(1)

wherein X is a divalent hydrocarbon group comprising 1 to 10 carbon atoms and R is independently a hydrogen atom or a monovalent hydrocarbon group comprising 1 to 4 carbon atoms

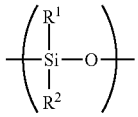

(2)

wherein $R^1$ is independently a monovalent hydrocarbon group comprising 1 to 12 carbon atoms and $R^2$ is independently selected from an aryl moiety, a $C_6$-$C_{12}$ alkylaryl moiety, and a $C_6$-$C_{12}$ alkyl moiety, said moieties optionally comprising an oxygen atom or a halogen atom, b) a non-linear organosilicone resin; and c) hydrophobic filler said composition being a laundry detergent and/or fabric enhancer is disclosed. When the siloxy unit of formula (2) is less than 10 mol % in the whole amount, sufficient antifoaming properties cannot be obtained.

Said organopolysiloxane can be produced by any known method, and can be easily obtained by adding α-methylstyrene, vinyltrimethoxysilane, or vinyltriethoxysilane, each of which has a terminal double bond, to hydrogenpolysiloxane in the presence of platinum or rhodium catalyst. The reaction can be optionally performed in the presence of solvent such as toluene. The reaction temperature is not particularly limited, but is preferably 60° C. or more and 150° C. or less. The reaction time is not particularly limited, but is preferably 0.5 to 10 hours, more preferably 1 to 5 hours.

Said antifoaming may be produced by any previous method, which method preferably contains a process of heat treating at a temperature of 50° C. to 200° C., more preferably 60° C. to 180° C. The heat temperature of 50° C. or more eliminates the risk of insufficient reaction, and the heat temperature of 200° C. or less eliminates the risk of decomposition of the siloxane bond. The reaction time is preferably 0.5 hours to 10 hours, more preferably 1 hour to 5 hours. The heat treating promotes intermolecular crosslinking of the organopolysiloxane, together with surface treatment of the non-linear organosilicone resin and the hydrophobic filler with the organopolysiloxane to further improve the antifoaming properties (persistence). These antifoaming compositions can be provided by mixing under shearing. Incidentally, the shearing means all the stirring including the use of an ordinal stirring blade, and the preferable sheared state is a state in which the hydrophobic filler is dispersed into the antifoaming composition. The method of preparing an antifoaming composition preferably contains an alkali treating step in any stage of mixing the antifoaming composition, preferably in a stage before the heat treating. Illustrative examples of the alkali substance include basic compounds that contains alkaline metal or alkaline earth metal, preferably potassium hydroxide, sodium hydroxide, potassium siliconate, sodium siliconate, sodium bicarbonate, potassium carbonate, and sodium carbonate. The temperature of the alkali treating is preferably 50° C. to 200° C., more preferably, 80° C. to 150° C. The reaction time is preferably 0.5 hours to 10 hours, more preferably 1 hour to 5 hours. The alkali treating promotes intermolecular crosslinking of the organopolysiloxane, together with surface treatment of the non-linear organosilicone resin and the hydrophobic filler with the organopolysiloxane to further improve the antifoaming properties (persistence). The addition amount of the alkali substance is preferably 0.01% to 10% by mass, more preferably 0.1% to 5% based on total antifoaming composition weight.

B. The composition according to Section A, wherein the antifoam's organopolysiloxane has formula (3)

(3)

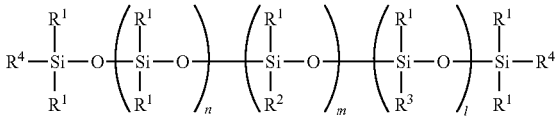

wherein:

a) each $R^1$ is independently a monovalent hydrocarbon group comprising 1 to 12 carbon atoms, preferably $R^1$ comprises a moiety selected from the group consisting of an alkyl moiety, an aryl moiety, an aralkyl moiety and an alkenyl moiety, more preferably $R^1$ comprises a moiety selected from the group consisting of a methyl moiety, an ethyl moiety, a propyl moiety, a butyl moiety, a pentyl moiety, a hexyl moiety, a heptyl moiety, an octyl moiety, a nonyl moiety, a decyl moiety, an undecyl moiety, a dodecyl moiety and a phenyl moiety, more preferably $R^1$ comprises a moiety selected from the group consisting of a methyl moiety, an ethyl moiety, a hexyl moiety and an octyl moiety, most preferably $R^1$ comprises a methyl moiety, and an ethyl moiety;

b) each $R^2$ is independently selected from an aryl moiety, a $C_6$-$C_{12}$ alkylaryl moiety, and a $C_6$-$C_{12}$ alkyl moiety, said moieties optionally comprising an oxygen atom or a halogen atom, preferably each $R^2$ is independently selected from a phenyl moiety, a 2-phenylpropyl moiety, an eugenol moiety, a phenylpropyl moiety, a propyl phenyl ether moiety, a propylphenol moiety, a 2-chlorostylyl moiety, a 4-chlorostylyl moiety, a 4-methylstylyl moiety, a 3-methylstylyl moiety, a 4-t-butylstylyl moiety, a 2,4-dimethylstylyl moiety, 2,5-dimethylstylyl moiety, more preferably each $R^2$ is independently selected from a 2-phenylpropyl moiety; Said 2-phenylpropyl-dimethylstylyl moiety may be derived from an α-methylstyrene.

c) $R^3$ is a hydrolyzable organic group of the formula (1) below:

(1)

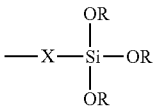

wherein for each $R^3X$ is independently a divalent hydrocarbon group, preferably for each $R^3X$ is independently an alkylene moiety comprising 1 to 10 carbon atoms, more preferably for each $R^3X$ is independently selected from the group consisting of a methylene moiety, an ethylene moiety, a propylene moiety and a butylene moiety; more preferably for each $R^3X$ is an ethylene moiety, and for each $R^3$ each R is independently a hydrogen atom or a monovalent hydrocarbon group comprising 1 to 4 carbon atoms, preferably for each $R^3$ each R is independently an alkylene moiety comprising 1 to 4 carbon atoms; more preferably a hydrogen atom, a methyl moiety, an ethyl moiety, or a propyl moiety; most preferably for each $R^3$ each R is independently a hydrogen atom, a methyl moiety, or an ethyl moiety;

d) each $R^4$ is independently $R^1$, an organic moiety selected from the group consisting of a hydrolyzable organic moiety of the formula (1), a hydroxy moiety and methoxy moiety, preferably each $R^4$ is a methyl moiety, e) n is an integer of 5 to 10,000, preferably n is an integer of 10 to 1,000;

f) m is an integer of 1 to 2000, preferably m is an integer of 10 to 200; and g) 1 is an integer of 1 to 20, preferably 1 is an integer of 1 to 10, more preferably 1 is an integer of 1 to 5;

preferably said organopolysiloxane has a dynamic viscosity of from about 200 $mm^2/s$ to about 50,000 $mm^2/s$ at 25° C., more preferably said organopolysiloxane has a dynamic viscosity of from about 800 $mm^2/s$ to about 20,000 $mm^2/s$ at 25° C. Said dynamic viscosity is measured with a Cannon-Fenske viscometer.

C. A composition according to Sections A to B, wherein the antifoam's non-linear organosilicone resin is a siloxane resin comprising $SiO_{4/2}$ units (Q unit) and $(R^5)_3SiO_{1/2}$ units (M unit) and each of said unit's $R^5$ is independently selected from the group consisting of a monovalent hydrocarbon group comprising 1 to 10 carbon atoms, hydrocarbonoxy group or hydroxyl group with the proviso that at least 10 mole % of said $R^5$ moieties are monovalent hydrocarbon groups preferably each $R^5$ is independently selected from the group consisting of an alkyl group comprising 1 to 6 carbon atoms, a phenyl group, a hydroxyl group or a methoxy group, most preferably each $R^5$ is independently selected from the group consisting of a methyl moiety, ethyl moiety a phenyl propyl moiety and a phenyl moiety; and the ratio of and $(R^5)_3SiO_{1/2}$ units to $SiO_{4/2}$ units in said siloxane resin is from about 0.4 to about 2.5, preferably from about 0.5 to about 1.4, more preferably from about 0.5 to about 0.8.

The organosilicone resin is preferably solid at room temperature, but liquid MQ resin can be appropriately used. It is most preferable that the non-linear organosilicone resin be exclusively consist of the M unit and the Q unit defined above, but it is also possible to use a resin that contains an M unit, a trivalent group (an $R^5SiO_{3/2}$ unit; i.e., a T unit), and a Q unit instead. In this case, the ratio of T units is preferably 0 to 30% by weight of said non-linear organosilicone resin. Such organosilicon resins can be produced by hydrolysis of silane, for example, in the presence or absence of solvent.

A particularly preferable method of making a suitable non-linear organosilicone resin is hydrolysis and condensation of a precursor of tetravalent siloxy unit (e.g., tetra-orthosilicate, tetraethylorthosilicate, polyethylsilicate, or sodium silicate) and a precursor of monovalent trialkylsiloxy unit (e.g., trimethylchlorosilane, trimethylethoxysilane, hexamethyldisiloxane, or hexamethyldisilazane) in the presence of solvent such as xylene. In addition, the obtained MQ resin can be optionally subjected to trimethylsilylation to react the remaining Si—OH group, or heating in the presence of base to bring about self-condensation of the resin caused by elimination of the Si—OH group.

D. A composition according to Sections A to C, wherein antifoam's non-linear organosilicone resin further comprises from about 0.1 to about 30% by the weight of resin of $R^5SiO_{3/2}$ units (T units).

E. The composition according to Section A to D comprising, based on total antifoam weight, a) from about 30% to about 90% of said organopolysiloxane, preferably from about 50% to about 80% of said organopolysiloxane;

b) from about 1% to about 50% of said non-linear organosilicone resin, preferably from about 2% to about 30% of said non-linear organosilicone resin, more preferably from about 4% to about 15% of said non-linear organosilicone resin; and/or c) from about 0.5% to about 50% of said hydrophobic filler, preferably from about 1% to about 15% of said hydrophobic filler, more preferably from about 2% to about 8% of said hydrophobic filler.

The about 30% to about 90% organopolysiloxane can give superior stability and antifoaming properties. The about 1% to about 50% of said non-linear organosilicone resin results in a superior anti-foam as when the non-linear organosilicone resin is to low the anti-foam's antifoaming benefit becomes insufficient while when the non-linear organosilicone resin is to high the anti-foam's workability is unsatisfactory. When the level of said hydrophobic filler greater than about 0.5% good anti-foaming capability is obtained and when the level of said hydrophobic filler is less than 50% the risk of negative the handling properties is minimized.

F. The composition according to Sections A to E wherein the antifoam further comprises, based on total antifoam weight, from about 0.5% to about 20% of an organic oil, preferably from about 1.5% to about 20% of said organic oil, more preferably from about 1% to about 15% most preferably from about 2% to about 10% of said organic oil.

The organic oil further improves the antifoaming stability. A single organic oil or combinations of organic oils may be used. The organic oil is typically insoluble to water and preferably contains less than 10% by mass of aromatic groups. The organic oil should be a liquid at the operating temperature of the antifoaming composition, which may be as high as 10° C. to 95° C. For many uses, the organic oil is preferably liquid at 25° C. Preferable organic oils include a mineral oil (particularly, a hydrogenated mineral oil or a clean oil), polyisobutene in a liquid state, isoparaffin oil, and a vegetable oil (e.g., a peanut oil, a coconut oil, an olive oil, a cottonseed oil, and a linseed oil), for example. Illustrative examples thereof include polypropylene glycol, polybutylene glycol, copolymer and block copolymer of polyethylene and polypropylene glycol; ester oil such as diisobutyl adipate, 2-hexyldecyl adipate, di-2-heptylundecyl adipate, an N-alkylglycol monoisostearate, isocetyl isostearate, trimethylolpropane triisostearate, ethylene glycol di-2-ethylhexanoate, neopentyl glycol di-2-ethylhexanoate, cetyl 2-ethylhexanoate, trimethylolpropane tri-2-ethylhexanoate, pentaerythritol tetra-2-ethylhexanoate, cetyl octanoate, octyl dodecyl gum ester, oleyl oleate, octyldodecyl oleate, decyl oleate, neopentyl glycol dicaprate, triethyl citrate, 2-ethylhexyl succinate, amyl acetate, ethyl acetate, butyl acetate, isocetyl stearate, butyl stearate, octyl stearate, diisopropyl sebacate, di-2-ethylhexyl sebacate, cetyl lactate, myristyl lactate, isopropyl palmitate, 2-ethylhexyl palmitate, 2-hexyldecyl palmitate, 2-heptylundecyl palmitate, cholesteryl 12-hydroxystearate, a dipentaerythritol fatty acid ester, isononyl isononanate, triisohexanoin, isopropyl myristate, 2-octyldodecyl myristate, 2-hexyldecyl myristate, myristyl myristate, hexyldecyl dimethyloctanoate, ethyl laurate, hexyl laurate, 2-octyldodecyl N-lauroyl-L-glutamate ester, diisostearyl malate, dextrin palmitate ester, dextrin stearate ester, dextrin 2-ethylhexanoate palmitate ester, sucrose palmitate ester, sucrose stearate ester, monobenzylidene sorbitol, dibenzylidene sorbitol; and ester of carboxylic acid and monovalent alcohol such as decanol, for example, dioctyl phthalate, dioctyl succinate, methyl caprylate, butyl pelargonate, ethyl stearate, 2-ethylhexyl stearate, dodecyl laurate or methyl melissate. Examples of organic fluids which are not liquid at 25° C. but are liquid at higher temperatures include vaseline, higher alcohols, and higher carboxylic acids such as myristic acid.

G. The composition according to according to Sections A to F comprising, based on total composition weight, less than 5% of said antifoam, preferably from about 0.01% to about 0.8% of said antifoam, more preferably from about 0.03 to about 0.25% of said antifoam. A detergent comprises the foregoing antifoaming composition and further comprises at least one surfactant and water. The detergent agent is based on a formulation that contains the surfactant and water. The surfactant helps to wet the surface of fabric, to come up dirt, and to stabilize dirt particles and liquid drops of oil. The surfactant is typically anionic surfactant, specifically alkylbenzene sulfonate, which may constitute 5 to 30% by mass of the whole detergent composition; or non-ionic surfactant such as 7-EO ethoxylate, which may constitute 5 to 40% by mass of the whole detergent composition. In addition, the detergent may contain the following components in accordance with needs: hydrotrope (e.g., salt of benzene sulfonate with a short chain such as xylene-, cumene-, and toluenesulfonate); builder to decrease hardness of water and to disperse dirt and soil particles in washing water (including sodium citrate, sodium salt of tartarate as well as mono- and di-succinate, STPP, silicate, carbonate, aluminosilicate, as well as zeolite); alcohols (which content is 5 to 10% by mass of the whole detergent composition, for example); enzyme and enzyme stabilizer (e.g., sodium formate and $CaCl_2$); cleaning auxiliaries (e.g., Borax and hydrogen peroxide); optical brighteners; perfumes; opacifiers; as well as base to adjust pH, for example, alkanol amine such as triethanolamine. Each of the contents of the detergent composition is based on the total mass of the detergent agent, and the remaining is water. This typical formulation may be altered to a special liquid detergent for intended washing use such as wool products, in which the anionic surfactant is replaced by cationic surfactant, and color care formulation that contains dye-transfer inhibitor.

H. The composition according to Sections A to G, wherein said antifoam is in a solid form, preferably in a form selected from the group consisting of a powder, an agglomerate, and mixtures thereof.

I. The composition according to Sections A to H, wherein the adjunct ingredient is selected from the group consisting of surfactants, color care polymers, deposition aids, surfactant boosting polymers, pH adjusters, product color stabilizers, preservatives, solvents, builders, chelating agents, dye transfer inhibiting agents, dispersants, enzymes, and enzyme stabilizers, catalytic materials, bleach, bleach activators, polymeric dispersing agents, clay soil removal/anti-redeposition agents, brighteners, suds suppressors, dyes, UV absorbers, perfume and perfume delivery systems, structure elasticizing agents, thickeners/structurants, fabric softeners, carriers, hydrotropes, oligoamines, processing aids, hueing agents, and/or pigments.

J. The composition according to Section I comprising a surfactant selected from the group consisting of anionic surfactant, cationic surfactant, nonionic surfactant, zwitterionic surfactant, ampholytic surfactant and mixtures thereof, preferably an anionic surfactant, preferably said anionic surfactant is selected from the group consisting of a $C_9$-$C_{18}$ alkyl benzene sulfonate surfactant; a $C_{10}$-$C_{20}$ alkyl sulfate surfactant; a $C_{10}$-$C_{18}$ alkyl alkoxy sulfate surfactant, said $C_{10}$-$C_{18}$ alkyl alkoxy sulfate surfactant having an average degree of alkoxylation of from 1 to 30 and the alkoxy comprises a $C_1$-$C_4$ chain, and mixtures thereof.

K. A composition according to Section I, wherein:

a) said fabric softener active is selected from the group consisting of polyglycerol esters, oily sugar derivatives, wax emulsions, fatty acids, N, N-bis(stearoyl-oxy-ethyl) N,N-dimethyl ammonium chloride, N,N-bis (tallowoyl-oxy-ethyl) N,N-dimethyl ammonium chloride, N,N-bis(stearoyl-oxy-ethyl)N-(2 hydroxy-ethyl)N-methyl ammonium methylsulfate and mixtures thereof;

b) said deposition aid polymer comprises a cationic polymer having a cationic charge of from about 0.005 meq/g to about 23 meq/g, preferably of from about 0.01 meq/g to about 12 meq/g, most preferably of from about 0.1 meq/g to about 7 meq/g at the pH of said composition;

c) said perfume delivery system comprises components selected from the group consisting of a perfume microcapsule, or a moisture-activated perfume microcapsule, wherein the microcapsule comprises a shell comprising a polyacrylate and/or a polymer crosslinked with an aldehyde, preferably said shell comprises a polymer selected from the group consisting of a polyacrylate, polyurea, polyurethane, polyamine, urea crosslinked with an aldehyde, or melamine crosslinked with an aldehyde, more preferably said polymer is selected from the group consisting of melamine-formaldehyde, urea-formaldehyde, phenol-formaldehyde, or other condensation polymers with formaldehyde, a perfume carrier and an encapsulated perfume composition, wherein said perfume carrier may be selected from the group consisting of cyclodextrins, starch microcapsules, porous carrier microcapsules, and mixtures thereof; and wherein said encapsulated perfume composition may comprise low volatile perfume ingredients, high volatile perfume ingredients, and mixtures thereof;

d) said enzyme is selected from the group consisting of protease, amylase, lipase, mannanase, cellulase, xyloglucanase, pectate lyase, and mixtures thereof;

e) said structurant is selected from the group of hydrogenated castor oil; derivatives of hydrogenated castor oil; microfibrillar cellulose; hydroxyfunctional crystalline materials, long-chain fatty alcohols, 12-hydroxystearic acid; clays; and mixtures thereof;

f) said polymeric dispersing agent is selected from the group consisting of polycarboxylates, soil release polymers, carboxymethylcelluloses, poly(vinyl-pyrrolidone), poly (ethylene glycol), poly(vinyl alcohol), poly (vinylpyridine-N-oxide), poly(vinylimidazole), zwitterionic ethoxylated quaternized sulfated hexamethylene diamine, alkoxylated polyalkylenimine, ethoxylated polyamine, polyethylene glycol-polyvinylacetate;

g) said hueing agent is selected from the group consisting of small molecule dyes, polymeric dyes, dye clay conjugates and pigments; and h) said oligoamine is selected from the group consisting of polyetheramines, and i) mixtures thereof.

L. A detergent and/or a fabric enhancer comprising an adjunct ingredient and an antifoam prepared by combining the organopolysiloxane, non-linear organosilicone resin, and hydrophobic filler according to any of Sections A through C to form a mixture and then heat treating said mixture at a temperature from about 50° C. to about 200° C.

M. A detergent and/or a fabric enhancer according to Section L, wherein the said antifoam preparation comprises combining, before said heat treating step, said organopolysiloxane, said non-linear organosilicone resin, said hydrophobic filler and an alkali substance to form a mixture.

N. A detergent and/or a fabric enhancer according to Sections L and M, wherein the said antifoam preparation further comprises combining an organic oil with said organopolysiloxane, non-linear organosilicone resin, hydrophobic filler and optionally said alkali substance to form a mixture.

Process of Making

The antifoam composition's disclosed and/or claimed herein can be made by in accordance with the teachings of the present specification, including the examples. In one aspect, when the silica requires in situ hydrophobization, the antifoam composition production process can include a heating step in which the silica, organomodified silicone, silicone resin, and/or other treating agent are mixed together at elevated temperature in the presence of a suitable catalyst such as potassium methoxide, potassium hydroxide, sodium methoxide and sodium hydroxide.

The compositions (a laundry detergents and/or fabric enhancers) disclosed and/or claimed herein can be made by in accordance with the teachings of the present specification, including the examples. In one aspect, such laundry detergents and/or fabric enhancers can be made by combining one or more of antifoam compositions disclosed and/or claimed herein with an adjunct ingredient Method of Use A method of treating and/or cleaning a situs, said method comprising a) optionally washing, rinsing and/or drying said situs;

b) contacting said situs with a composition according to any one of Sections A through N; and c) optionally washing, rinsing, and/or drying said situs, via passive or active drying is disclosed.

Adjunct Ingredients

While not essential for each consumer product embodiment of the present invention, the non-limiting list of consumer product ingredients illustrated hereinafter are suitable for use in Applicants' compositions and may be desirably incorporated in certain embodiments of the invention, for example to assist or enhance performance, for treatment of the substrate to be cleaned, or to modify the aesthetics of the composition as is the case with perfumes, colorants, dyes or the like. The precise nature of these consumer product ingredients, and levels of incorporation thereof, will depend on the physical form of the composition and the nature of the operation for which it is to be used. Suitable consumer product ingredients include, but are not limited to surfactants, color care polymers, deposition aids, surfactant boosting polymers, pH adjusters, product color stabilizers, preservatives, solvents, builders, chelating agents, dye transfer inhibiting agents, dispersants, enzymes, and enzyme stabilizers, catalytic materials, bleach, bleach activators, polymeric dispersing agents, clay soil removal/anti-redeposition agents, brighteners, suds suppressors, dyes, UV absorbers, perfume and perfume delivery systems, structure elasticizing agents, thickeners/structurants, fabric softeners, carriers, hydrotropes, oligoamines, processing aids, hueing agents, and/or pigments.

As stated, the consumer product ingredients are not essential for each consumer product embodiment of the present invention. Thus, certain embodiments of Applicants' compositions do not contain one or more of the following adjuncts materials: surfactants, color care polymers, deposition aids, surfactant boosting polymers, pH adjusters, product color stabilizers, preservatives, solvents, builders, chelating agents, dye transfer inhibiting agents, dispersants, enzymes, and enzyme stabilizers, catalytic materials, bleach, bleach activators, polymeric dispersing agents, clay soil removal/anti-redeposition agents, brighteners, suds suppressors, dyes, UV absorbers, perfume and perfume delivery systems, structure elasticizing agents, thickeners/structurants, fabric softeners, carriers, hydrotropes, oligoamines, processing aids, hueing agents, and/or pigments. However, when one or more consumer product ingredients is present, such one or more consumer product ingredients may be present as detailed below.

The Quaternary Ammonium Ester Softening Active

The composition of the present invention may comprise from 3.0% to 25.0% of a quaternary ammonium ester softening active (Fabric Softening Active, "FSA"). The term ester quaternary ammonium compound is synonymous with quaternary ammonium ester softening active. In preferred liquid fabric softener compositions, the quaternary ammonium ester softening active is present at a level of from 4.0% to 20%, more preferably from 5.0% to 15%, even more preferably from 7.0% to 12% by weight of the composition. The level of quaternary ammonium ester softening active may depend of the desired concentration of total softening active in the composition (diluted or concentrated composition) and of the presence or not of other softening active.

Preferably the iodine value of the parent fatty acid from which the quaternary ammonium fabric softening active is formed is from 0 to 100, preferably from 10 to 60, more preferably 15 to 45.

Suitable quaternary ammonium ester softening actives include but are not limited to, materials selected from the group consisting of monoester quats, diester quats, triester quats and mixtures thereof. Preferably, the level of monoester quat is from 2.0% to 40.0%, the level of diester quat is from 40.0% to 98.0%, the level of triester quat is from 0.0% to 25.0% by weight of total quaternary ammonium ester softening active.

Said quaternary ammonium ester softening active may comprise compounds of the following formula:

$$\{R^2_{(4-m)}—N+-[X—Y—R^1]_m\}A-$$

wherein:

m is 1, 2 or 3 with proviso that the value of each m is identical;

each $R^1$ is independently hydrocarbyl, or branched hydrocarbyl group, preferably $R^1$ is linear, more preferably $R^1$ is partially unsaturated linear alkyl chain;

each $R^2$ is independently a $C_1$-$C_3$ alkyl or hydroxyalkyl group, preferably $R^2$ is selected from methyl, ethyl, propyl, hydroxyethyl, 2-hydroxypropyl, 1-methyl-2-hydroxyethyl, poly($C_{2-3}$ alkoxy), polyethoxy, benzyl;

each X is independently $(CH_2)_n$, $CH_2$—$CH(CH_3)$— or CH—$(CH_3)$—$CH_2$— and each n is independently 1, 2, 3 or 4, preferably each n is 2;

each Y is independently —O—(O)C— or —C(O)—O—;

A- is independently selected from the group consisting of chloride, methylsulfate, and ethylsulfate, preferably A- is selected from the group consisting of chloride and methylsulfate;

with the proviso that when Y is —O—(O)C—, the sum of carbons in each $R^1$ is from 13 to 21, preferably from 13 to 19.

Examples of suitable quaternary ammonium ester softening actives are commercially available from KAO Chemicals under the trade name Tetranyl AT-1 and Tetranyl AT-7590, from Evonik under the tradename Rewoquat WE16 DPG, Rewoquat WE18, Rewoquat WE20, Rewoquat WE28, and Rewoquat 38 DPG, from Stepan under the tradename Stepantex GA90, Stepantex VR90, Stepantex VK90, Stepantex VA90, Stepantex DC90, Stepantex VL90A.

These types of agents and general methods of making them are disclosed in U.S. Pat. No. 4,137,180.

Additional Fabric Softening Active

The composition of the present invention may comprise from 0.01% to 10%, preferably from 0.1% to 10%, more preferably from 0.1% to 5% of additional fabric softening active. Suitable fabric softening actives, include, but are not limited to, materials selected from the group consisting of non-ester quaternary ammonium compounds, amines, fatty esters, sucrose esters, silicones, dispersible polyolefins, polysaccharides, fatty acids, softening oils, polymer latexes and combinations thereof.

Non-Ester Quaternary Ammonium Compounds:

Suitable non-ester quaternary ammonium compounds comprise compounds of the formula:

$$[R_{(4-m)}—N^+—R^1_m]X^-$$

wherein each R comprises either hydrogen, a short chain $C_1$-$C_6$, in one aspect a $C_1$-$C_3$ alkyl or hydroxyalkyl group, for example methyl, ethyl, propyl, hydroxyethyl, poly($C_{2-3}$ alkoxy), polyethoxy, benzyl, or mixtures thereof; each m is 1, 2 or 3 with the proviso that the value of each m is the same; the sum of carbons in each $R^1$ may be $C_{12}$-$C_{22}$, with each $R^1$ being a hydrocarbyl, or substituted hydrocarbyl group; and $X^-$ may comprise any softener-compatible anion. The softener-compatible anion may comprise chloride, bromide, methylsulfate, ethylsulfate, sulfate, and nitrate. The softener-compatible anion may comprise chloride or methyl sulfate.

Non-limiting examples include dialkylenedimethylammonium salts such as dicanoladimethylammonium chloride, di(hard)tallowdimethylammonium chloride dicanoladimethylammonium methylsulfate, and mixtures thereof. An example of commercially available dialkylenedimethylammonium salts usable in the present invention is dioleyldimethylammonium chloride available from Witco Corporation under the trade name Adogen® 472 and dihardtallow dimethylammonium chloride available from Akzo Nobel Arquad 2HT75.

Amines:

Suitable amines include but are not limited to, materials selected from the group consisting of amidoesteramines, amidoamines, imidazoline amines, alkyl amines, and combinations thereof. Suitable ester amines include but are not limited to, materials selected from the group consisting of monoester amines, diester amines, triester amines and combinations thereof. Suitable amidoamines include but are not limited to, materials selected from the group consisting of monoamido amines, diamido amines and combinations thereof. Suitable alkyl amines include but are not limited to, materials selected from the group consisting of mono alkylamines, dialkyl amines quats, trialkyl amines, and combinations thereof.

Fatty Acid:

The composition may comprise a fatty acid, such as a free fatty acid as fabric softening active. The term "fatty acid" is used herein in the broadest sense to include unprotonated or protonated forms of a fatty acid. One skilled in the art will readily appreciate that the pH of an aqueous composition will dictate, in part, whether a fatty acid is protonated or unprotonated. The fatty acid may be in its unprotonated, or salt form, together with a counter ion, such as, but not limited to, calcium, magnesium, sodium, potassium, and the like. The term "free fatty acid" means a fatty acid that is not bound to another chemical moiety (covalently or otherwise).

The fatty acid may include those containing from 12 to 25, from 13 to 22, or even from 16 to 20, total carbon atoms, with the fatty moiety containing from 10 to 22, from 12 to 18, or even from 14 (mid-cut) to 18 carbon atoms.

The fatty acids may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, castor oil, etc.; (3) processed and/or bodied oils, such as linseed oil or tung oil via thermal, pressure, alkali-isomerization and catalytic treatments; (4) combinations thereof, to yield saturated (e.g. stearic acid), unsaturated (e.g. oleic acid), polyunsaturated (linoleic acid), branched (e.g. isostearic acid) or cyclic (e.g. saturated or unsaturated disubstituted cyclopentyl or cyclohexyl derivatives of polyunsaturated acids) fatty acids.

Mixtures of fatty acids from different fat sources can be used.

The cis/trans ratio for the unsaturated fatty acids may be important, with the cis/trans ratio (of the C18:1 material) being from at least 1:1, at least 3:1, from 4:1 or even from 9:1 or higher.

Branched fatty acids such as isostearic acid are also suitable since they may be more stable with respect to oxidation and the resulting degradation of color and odor quality. The fatty acid may have an iodine value from 0 to 140, from 50 to 120 or even from 85 to 105.

Polysaccharides:

The composition may comprise a polysaccharide as a fabric softening active, such as cationic starch. Suitable cationic starches for use in the present compositions are commercially-available from Cerestar under the trade name C*BOND® and from National Starch and Chemical Company under the trade name CATO® 2A.

Sucrose Esters:

The composition may comprise a sucrose esters as a fabric softening active. Sucrose esters are typically derived from sucrose and fatty acids. Sucrose ester is composed of a sucrose moiety having one or more of its hydroxyl groups esterified.

Sucrose is a disaccharide having the following formula:

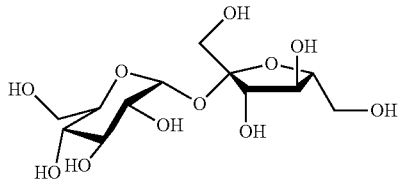

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8−x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

The $R^1$ moieties may comprise linear alkyl or alkoxy moieties having independently selected and varying chain length. For example, $R^1$ may comprise a mixture of linear alkyl or alkoxy moieties wherein greater than 20% of the linear chains are $C_{18}$, alternatively greater than 50% of the linear chains are Cis, alternatively greater than 80% of the linear chains are $C_{18}$.

The $R^1$ moieties may comprise a mixture of saturate and unsaturated alkyl or alkoxy moieties. The iodine value (IV) of the sucrose esters suitable for use herein ranges from 1 to 150, or from 2 to 100, or from 5 to 85. The $R^1$ moieties may be hydrogenated to reduce the degree of unsaturation. In the case where a higher IV is preferred, such as from 40 to 95, then oleic acid and fatty acids derived from soybean oil and canola oil are suitable starting materials.

The unsaturated $R^1$ moieties may comprise a mixture of "cis" and "trans" forms the unsaturated sites. The "cis"/"trans" ratios may range from 1:1 to 50:1, or from 2:1 to 40:1, or from 3:1 to 30:1, or from 4:1 to 20:1.

Dispersible Polyolefins and Latexes:

Generally, all dispersible polyolefins that provide fabric softening benefits can be used as fabric softening active in the present invention. The polyolefins can be in the form of waxes, emulsions, dispersions or suspensions.

The polyolefin may be chosen from a polyethylene, polypropylene, or combinations thereof. The polyolefin may be at least partially modified to contain various functional groups, such as carboxyl, alkylamide, sulfonic acid or amide groups. The polyolefin may be at least partially carboxyl modified or, in other words, oxidized.

Non-limiting examples of fabric softening active include dispersible polyethylene and polymer latexes. These agents can be in the form of emulsions, latexes, dispersions, suspensions, and the like. In one aspect, they are in the form of an emulsion or a latex. Dispersible polyethylenes and polymer latexes can have a wide range of particle size diameters ($\chi_{50}$) including but not limited to from 1 nm to 100 μm; alternatively from 10 nm to 10 μm. As such, the particle sizes of dispersible polyethylenes and polymer latexes are generally, but without limitation, smaller than silicones or other fatty oils.

Generally, any surfactant suitable for making polymer emulsions or emulsion polymerizations of polymer latexes can be used as emulsifiers for polymer emulsions and latexes used as fabric softeners active in the present invention. Suitable surfactants include anionic, cationic, and nonionic surfactants, and combinations thereof. In one aspect, such surfactants are nonionic and/or anionic surfactants. In one aspect, the ratio of surfactant to polymer in the fabric softening active is 1:5, respectively.

Additional Silicone

The fabric softening composition may comprise a silicone in addition to the silicones that comprise backbones that are cleavable. Suitable levels of silicone may comprise from about 0.1% to about 70%, alternatively from about 0.3% to about 40%, alternatively from about 0.5% to about 30%, alternatively from about 1% to about 20% by weight of the composition. Useful silicones can be any silicone comprising compound. In one embodiment, the silicone polymer is selected from the group consisting of cyclic silicones, polydimethylsiloxanes, aminosilicones, cationic silicones, silicone polyethers, silicone resins, silicone urethanes, and mixtures thereof. The silicone may be a polydialkylsilicone, alternatively a polydimethyl silicone (polydimethyl siloxane or "PDMS"), or a derivative thereof. The silicone may be chosen from an aminofunctional silicone, amino-polyether silicone, alkyloxylated silicone, cationic silicone, ethoxylated silicone, propoxylated silicone, ethoxylated/propoxylated silicone, quaternary silicone, or combinations thereof.

The silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein:

j is an integer from 0 to about 98; in one aspect j is an integer from 0 to about 48; in one aspect, j is 0;

k is an integer from 0 to about 200, in one aspect k is an integer from 0 to about 50; when k=0, at least one of $R_1$, $R_2$ or $R_3$ is —X—Z;

m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z; each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X in said alkyl siloxane polymer comprises a substituted or unsubstituted divalent alkylene radical comprising 2-12 carbon atoms, in one aspect each divalent alkylene radical is independently selected from the group consisting of $—(CH_2)_s—$ wherein s is an integer from about 2 to about 8, from about 2 to about 4; in one aspect, each X in said alkyl siloxane polymer comprises a substituted divalent alkylene radical selected from the group consisting of: $—CH_2—CH(OH)—CH_2—$; $—CH_2—CH_2—CH(OH)—$; and

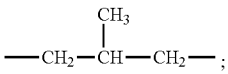

each Z is selected independently from the group consisting of

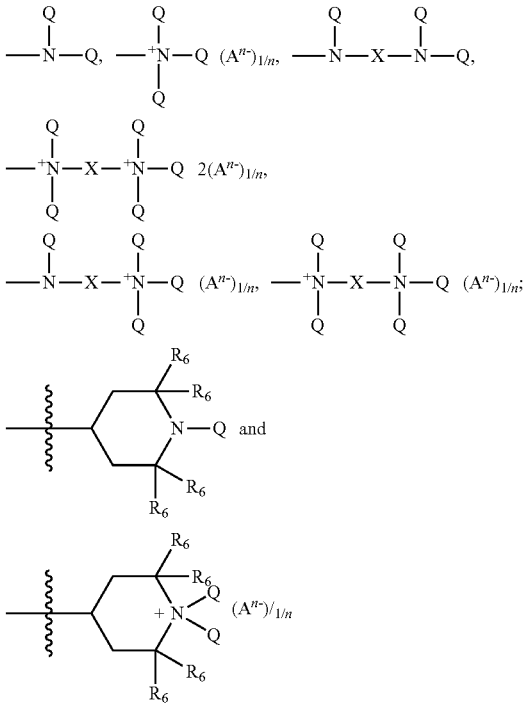

with the proviso that when Z is a quat, Q cannot be an amide, imine, or urea moiety and if Q is an amide, imine, or urea moiety, then any additional Q bonded to the same nitrogen as said amide, imine, or urea moiety must be H or a $C_1$-$C_6$ alkyl, in one aspect, said additional Q is H; for Z $A^{n-}$ is a suitable charge balancing anion. In one aspect, $A^{n-}$ is selected from the group consisting of $Cl^-$, $Br^-$, $I^-$, methylsulfate, toluene sulfonate, carboxylate and phosphate; and at least one Q in said organosilicone is independently selected from $—CH_2—CH(OH)—CH_2—R_5$;

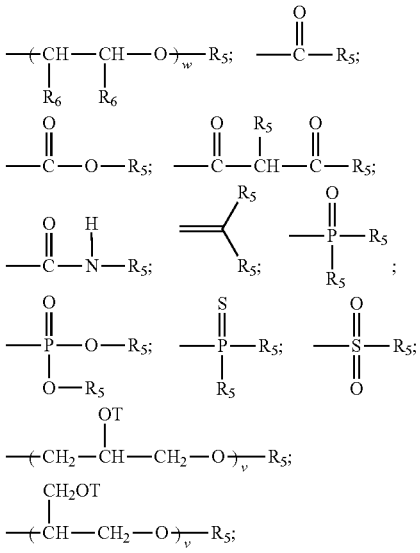

-continued

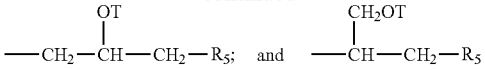

each additional Q in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$CH_2$—CH(OH)—$CH_2$—$R_5$;

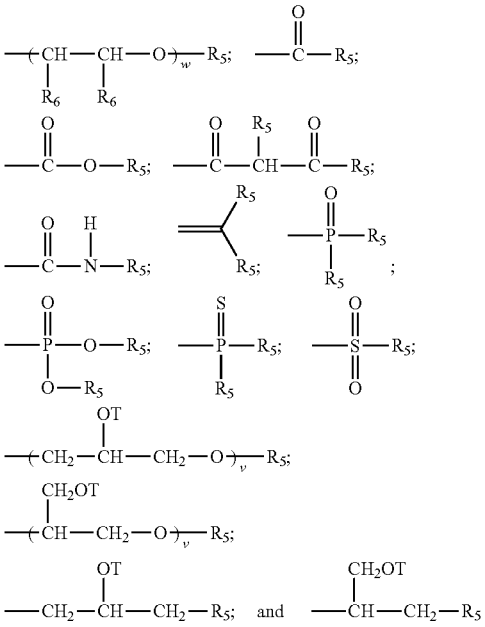

wherein each $R_5$ is independently selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, —$(CHR_6$—$CHR_6$—O—$)_w$-L and a siloxyl residue;

each $R_6$ is independently selected from H, $C_1$-$C_{18}$ alkyl each L is independently selected from —C(O)—$R_7$ or $R_7$;

w is an integer from 0 to about 500, in one aspect w is an integer from about 1 to about 200; in one aspect w is an integer from about 1 to about 50;

each $R_7$ is selected independently from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl; $C_6$-$C_{32}$ substituted alkylaryl and a siloxyl residue;

each T is independently selected from H, and

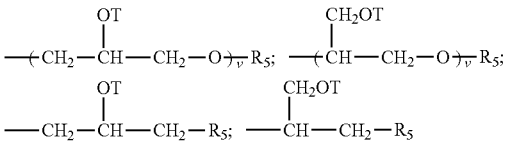

and wherein each v in said organosilicone is an integer from 1 to about 10, in one aspect, v is an integer from 1 to about 5 and the sum of all v indices in each Q in the said organosilicone is an integer from 1 to about 30 or from 1 to about 20 or even from 1 to about 10.

The silicone may be chosen from a random or blocky organosilicone polymer having the following formula:

$$[R_1R_2R_3SiO_{1/2}]_{(j+2)}[(R_4Si(X—Z)O_{2/2}]_k[R_4R_4SiO_{2/2}]_m[R_4SiO_{3/2}]_j$$

wherein j is an integer from 0 to about 98; in one aspect j is an integer from 0 to about 48; in one aspect, j is 0;

k is an integer from 0 to about 200; when k=0, at least one of $R_1$, $R_2$ or $R_3$=—X—Z, in one aspect, k is an integer from 0 to about 50 m is an integer from 4 to about 5,000; in one aspect m is an integer from about 10 to about 4,000; in another aspect m is an integer from about 50 to about 2,000;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy and X—Z;

each $R_4$ is independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy and $C_1$-$C_{32}$ substituted alkoxy;

each X comprises of a substituted or unsubstituted divalent alkylene radical comprising 2-12 carbon atoms; in one aspect each X is independently selected from the group consisting of —$(CH_2)_s$—O—; —$CH_2$—CH(OH)—$CH_2$—O—;

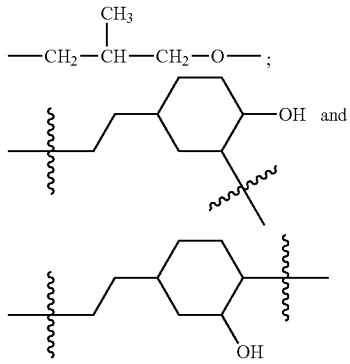

wherein each s independently is an integer from about 2 to about 8, in one aspect s is an integer from about 2 to about 4;

At least one Z in the said organosiloxane is selected from the group consisting of $R_5$;

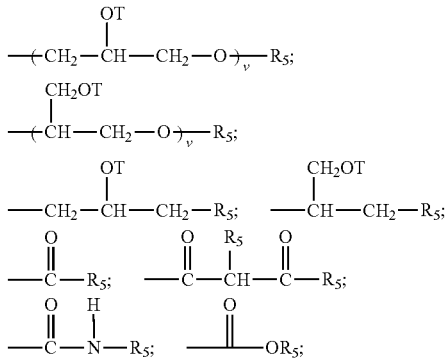

-continued

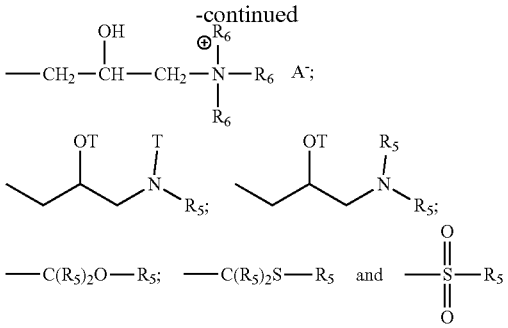

provided that when X is

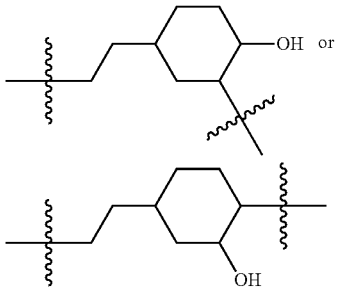

then Z═—$OR_5$ or

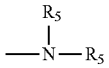

wherein $A^-$ is a suitable charge balancing anion. In one aspect $A^-$ is selected from the group consisting of $Cl^-$, $Br^-$, $I^-$, methylsulfate, toluene sulfonate, carboxylate and phosphate and each additional Z in said organosilicone is independently selected from the group comprising of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $R_5$,

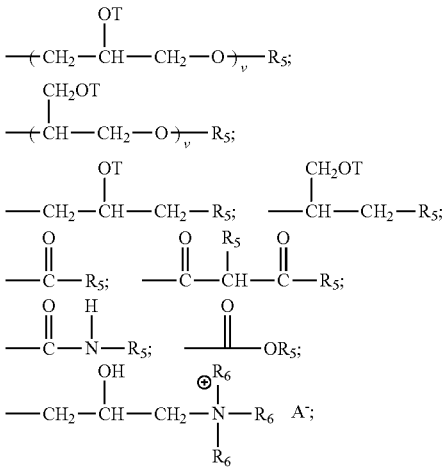

-continued

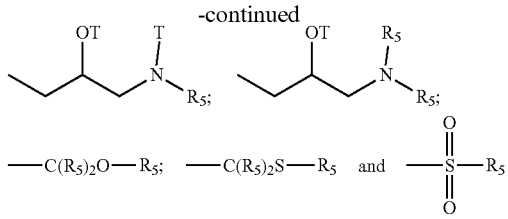

provided that when X

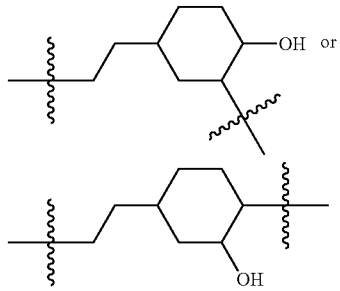

then Z═—$OR_5$ or

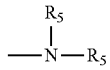

each $R_5$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl or $C_6$-$C_{32}$ alkylaryl, or $C_6$-$C_{32}$ substituted alkylaryl, —$(CHR_6$—$CHR_6$—O—$)_w$—$CHR_6$—$CHR_6$-L and siloxyl residue wherein each L is independently selected from —O—C(O)—$R_7$ or —O—$R_7$;

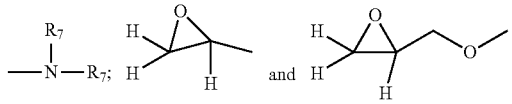

w is an integer from 0 to about 500, in one aspect w is an integer from 0 to about 200, one aspect w is an integer from 0 to about 50;

each $R_6$ is independently selected from H or $C_1$-$C_{18}$ alkyl;

each $R_7$ is independently selected from the group consisting of H; $C_1$-$C_{32}$ alkyl; $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted aryl, and a siloxyl residue;

each T is independently selected from H;

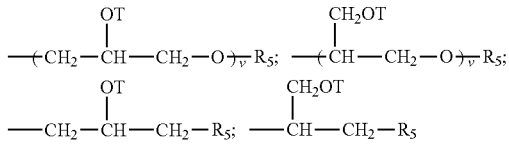

wherein each v in said organosilicone is an integer from 1 to about 10, in one aspect, v is an integer from 1 to about 5 and the sum of all v indices in each Z in the said organosilicone is an integer from 1 to about 30 or from 1 to about 20 or even from 1 to about 10.

The silicone may comprise a relatively high molecular weight. A suitable way to describe the molecular weight of a silicone includes describing its viscosity. A high molecular weight silicone is one having a viscosity of from about 10 cSt to about 3,000,000 cSt, or from about 100 cSt to about 1,000,000 cSt, or from about 1,000 cSt to about 600,000 cSt, or even from about 6,000 cSt to about 300,000 cSt.

The silicone may comprise a blocky cationic organopolysiloxane having the formula:

$$M_wD_xT_yQ_z$$

wherein:

M=[$SiR_1R_2R_3O_{1/2}$], [$SiR_1R_2G_1O_{1/2}$], [$SiR_1G_1G_2O_{1/2}$], [$SiG_1G_2G_3O_{1/2}$], or combinations thereof;

D=[$SiR_1R_2O_{2/2}$], [$SiR_1G_1O_{2/2}$], [$SiG_1G_2O_{2/2}$] or combinations thereof;

T=[$SiR_1O_{3/2}$], [$SiG_1O_{3/2}$] or combinations thereof;

Q=[$SiO_{4/2}$];

w=is an integer from 1 to (2+y+2z);

x=is an integer from 5 to 15,000;

y=is an integer from 0 to 98;

z=is an integer from 0 to 98;

$R_1$, $R_2$ and $R_3$ are each independently selected from the group consisting of H, OH, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, $C_6$-$C_{32}$ substituted alkylaryl, $C_1$-$C_{32}$ alkoxy, $C_1$-$C_{32}$ substituted alkoxy, $C_1$-$C_{32}$ alkylamino, and $C_1$-$C_{32}$ substituted alkylamino;

at least one of M, D, or T incorporates at least one moiety $G_1$, $G_2$ or $G_3$; and $G_1$, $G_2$, and $G_3$ are each independently selected from the formula:

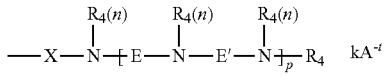

wherein:

X comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide, and ring-opened glycidyl, with the proviso that if X does not comprise a repeating alkylene oxide moiety then X can further comprise a heteroatom selected from the group consisting of P, N and O;

each $R_4$ comprises identical or different monovalent radicals selected from the group consisting of H, $C_1$-$C_{32}$ alkyl, $C_1$-$C_{32}$ substituted alkyl, $C_5$-$C_{32}$ or $C_6$-$C_{32}$ aryl, $C_5$-$C_{32}$ or $C_6$-$C_{32}$ substituted aryl, $C_6$-$C_{32}$ alkylaryl, and $C_6$-$C_{32}$ substituted alkylaryl;

E comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E does not comprise a repeating alkylene oxide moiety then E can further comprise a heteroatom selected from the group consisting of P, N, and O;

E' comprises a divalent radical selected from the group consisting of $C_1$-$C_{32}$ alkylene, $C_1$-$C_{32}$ substituted alkylene, $C_5$-$C_{32}$ or $C_6$-$C_{32}$ arylene, $C_5$-$C_{32}$ or $C_6$-$C_{32}$ substituted arylene, $C_6$-$C_{32}$ arylalkylene, $C_6$-$C_{32}$ substituted arylalkylene, $C_1$-$C_{32}$ alkoxy, $C_1$-$C_{32}$ substituted alkoxy, $C_1$-$C_{32}$ alkyleneamino, $C_1$-$C_{32}$ substituted alkyleneamino, ring-opened epoxide and ring-opened glycidyl, with the proviso that if E' does not comprise a repeating alkylene oxide moiety then E' can further comprise a heteroatom selected from the group consisting of P, N, and O;

p is an integer independently selected from 1 to 50;

n is an integer independently selected from 1 or 2;

when at least one of $G_1$, $G_2$, or $G_3$ is positively charged, $A^{-t}$ is a suitable charge balancing anion or anions such that the total charge, k, of the charge-balancing anion or anions is equal to and opposite from the net charge on the moiety $G_1$, $G_2$ or $G_3$; wherein t is an integer independently selected from 1, 2, or 3; and $k \leq (p*2/t)+1$; such that the total number of cationic charges balances the total number of anionic charges in the organopolysiloxane molecule; and wherein at least one E does not comprise an ethylene moiety.

Additional Surfactants

In some examples, the additional surfactant comprises one or more anionic surfactants. In some examples, the additional surfactant may consist essentially of, or even consist of one or more anionic surfactants.

Specific, non-limiting examples of suitable anionic surfactants include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates.

Alkoxylated alkyl sulfate materials comprise ethoxylated alkyl sulfate surfactants, also known as alkyl ether sulfates or alkyl polyethoxylate sulfates. Examples of ethoxylated alkyl sulfates include water-soluble salts, particularly the alkali metal, ammonium and alkylolammonium salts, of organic sulfuric compounds having in their molecular structure an alkyl group containing from about 8 to about 30 carbon atoms and a sulfonic acid and its salts. (Included in the term "alkyl" is the alkyl portion of acyl groups. In some examples, the alkyl group contains from about 15 carbon atoms to about 30 carbon atoms. In other examples, the alkyl ether sulfate surfactant may be a mixture of alkyl ether sulfates, said mixture having an average (arithmetic mean) carbon chain length within the range of about 12 to 30 carbon atoms, and in some examples an average carbon chain length of about 12-15 carbon atoms, and an average (arithmetic mean) degree of ethoxylation of from about 1 mol to 4 mols of ethylene oxide, and in some examples an average (arithmetic mean) degree of ethoxylation of about 1.8 mols to about 4 mols of ethylene oxide. In further examples, the alkyl ether sulfate surfactant may have a carbon chain length between about 10 carbon atoms to about 18 carbon atoms, and a degree of ethoxylation of from about 1 to about 6 mols of ethylene oxide. In yet further examples, the alkyl ether sulfate surfactant may contain a peaked ethoxylate distribution, Non-ethoxylated alkyl sulfates may also be added to the disclosed cleaning compositions and used as an anionic surfactant component. Examples of non-alkoxylated, e.g., non-ethoxylated, alkyl sulfate surfactants include those produced by the sulfation of higher $C_8$-$C_{20}$ fatty alcohols. In some examples, primary alkyl sulfate surfactants have the general formula: $ROSO_3^-M^+$, wherein R is typically a linear $C_8$-$C_{20}$ hydrocarbyl group, which may be straight chain or branched chain, and M is a water-solubilizing cation. In some examples, R is a $C_{10}$-$C_{15}$ alkyl, and M is an alkali metal. In other examples, R is a $C_{12}$-$C_{14}$ alkyl and M is sodium.

Other useful anionic surfactants can include the alkali metal salts of alkyl benzene sulfonates, in which the alkyl group contains from about 9 to about 15 carbon atoms, in straight chain (linear) or branched chain configuration. In some examples, the alkyl group is linear. Such linear alkylbenzene sulfonates are known as "LAS." In other examples, the linear alkylbenzene sulfonate may have an average number of carbon atoms in the alkyl group of from about 11 to 14. In a specific example, the linear straight chain alkyl benzene sulfonates may have an average number of carbon atoms in the alkyl group of about 11.8 carbon atoms, which may be abbreviated as C11.8 LAS.

Suitable alkyl benzene sulphonate (LAS) may be obtained, by sulphonating commercially available linear alkyl benzene (LAB); suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic detersive surfactant is alkyl benzene sulphonate that is obtained by DETAL catalyzed process, although other synthesis routes, such as HF, may also be suitable. A magnesium salt of LAS may be used.

The detersive surfactant may be a mid-chain branched detersive surfactant preferably a mid-chain branched anionic detersive surfactant, more preferably a mid-chain branched alkyl sulphate and/or a mid-chain branched alkyl benzene sulphonate, for example, a mid-chain branched alkyl sulphate. The mid-chain branches may be $C_{1-4}$ alkyl groups, typically methyl and/or ethyl groups.

Other anionic surfactants useful herein are the water-soluble salts of: paraffin sulfonates and secondary alkane sulfonates containing from about 8 to about 24 (and in some examples about 12 to 18) carbon atoms; alkyl glyceryl ether sulfonates, especially those ethers of $C_{8-18}$ alcohols (e.g., those derived from tallow and coconut oil). Mixtures of the alkylbenzene sulfonates with the above-described paraffin sulfonates, secondary alkane sulfonates and alkyl glyceryl ether sulfonates are also useful. Further suitable anionic surfactants include methyl ester sulfonates and alkyl ether carboxylates.

Nonionic Surfactants

The additional surfactant may comprise one or more nonionic surfactants. The detergent composition may comprise from about 0.1% to about 40%, by weight of the composition, of an additional surfactant selected from one or more nonionic surfactants. The detergent composition may comprise from about 0.1% to about 15%, by weight of the composition, of an additional surfactant selected from one or more nonionic surfactants. The detergent composition may comprise from about 0.3% to about 10%, by weight of the composition, of an additional surfactant selected from one or more nonionic surfactants.

Suitable nonionic surfactants useful herein can comprise any conventional nonionic surfactant. These can include, for e.g., alkoxylated fatty alcohols and amine oxide surfactants. In some examples, the cleaning compositions may contain an ethoxylated nonionic surfactant. The nonionic surfactant may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 17 carbon atoms and alkyl phenyl radicals in which the alkyl groups contain from about 8 to about 12 carbon atoms, and the average value of n is from about 5 to about 15. The nonionic surfactant may be selected from ethoxylated alcohols having an average of about 24 carbon atoms in the alcohol and an average degree of ethoxylation of about 9 moles of ethylene oxide per mole of alcohol.

Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols, alkylpolysaccharides, polyhydroxy fatty acid amides and ether capped poly(oxyalkylated) alcohol surfactants Suitable nonionic detersive surfactants also include alkyl polyglucoside and alkyl alkoxylated alcohol. Suitable nonionic surfactants also include those sold under the tradename Lutensol® from BASF.

The nonionic surfactant may be selected from alkyl alkoxylated alcohols, such as a $C_{8-18}$ alkyl alkoxylated alcohol, for example, a $C_{8-18}$ alkyl ethoxylated alcohol. The alkyl alkoxylated alcohol may have an average degree of alkoxylation of from about 1 to about 50, or from about 1 to about 30, or from about 1 to about 20, or from about 1 to about 10. In certain aspects, the alkyl alkoxylated alcohol is a $C_{8-18}$ alkyl ethoxylated alcohol having an average degree of ethoxylation of from about 1 to about 10, or from about 1 to about 7, or from about 1 to about 5, or from about 3 to about 7. The alkyl alkoxylated alcohol can be linear or branched, substituted or unsubstituted.

Enzymes

The compositions described herein may comprise one or more enzymes which provide cleaning performance and/or fabric care benefits. Examples of suitable enzymes include, but are not limited to, hemicellulases, peroxidases, proteases, cellulases, xylanases, lipases, xyloglucanase, phospholipases, esterases, cutinases, pectinases, mannanases, pectate lyases, keratinases, reductases, oxidases, phenoloxidases, lipoxygenases, ligninases, pullulanases, tannases, pentosanases, malanases, ß-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in a detergent composition, the aforementioned additional enzymes may be present at levels from about 0.00001% to about 2%, from about 0.0001% to about 1% or even from about 0.001% to about 0.5% enzyme protein by weight of the detergent composition.

Preferred enzymes may include a protease. Suitable proteases include metalloproteases and serine proteases, including neutral or alkaline microbial serine proteases, such as subtilisins (EC 3.4.21.62). Suitable proteases include those of animal, vegetable or microbial origin. Suitable protease may be of microbial origin. The suitable proteases include chemically or genetically modified mutants of the aforementioned suitable proteases. The suitable protease may be a serine protease, such as an alkaline microbial protease or/and a trypsin-type protease.

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP, BLAP X and BLAP F49—all from Henkel/Kemira; and KAP from Kao.

Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE® and PURASTAR OXAM® (Genencor International Inc., Palo Alto, Calif.) and KAM® (Kao, 14-10 Nihonbashi Kayabacho, 1-chome, Chuo-ku Tokyo 103-8210, Japan). In one aspect, suitable amylases include NATALASE®, STAINZYME® and STAINZYME PLUS® and mixtures thereof.

In one aspect, such enzymes may be selected from the group consisting of: lipases, including "first cycle lipases". Preferred lipases would include those sold under the tradenames Lipex® and Lipolex®.

In one aspect, other preferred enzymes include microbial-derived endoglucanases. Suitable endoglucanases are sold under the tradenames Celluclean® and Whitezyme® (Novozymes A/S, Bagsvaerd, Denmark).

Other preferred enzymes include pectate lyases sold under the tradenames Pectawash®, Pectaway®, Xpect® and mannanases sold under the tradenames Mannaway® (all from Novozymes A/S, Bagsvaerd, Denmark), and Purabrite® (Genencor International Inc., Palo Alto, Calif.).

Enzyme Stabilizing System

The enzyme-containing compositions described herein may optionally comprise from about 0.001% to about 10%, in some examples from about 0.005% to about 8%, and in other examples, from about 0.01% to about 6%, by weight of the composition, of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, chlorine bleach scavengers and mixtures thereof, and are designed to address different stabilization problems depending on the type and physical form of the cleaning composition.

Builders

The cleaning compositions of the present invention may optionally comprise a builder. Built cleaning compositions typically comprise at least about 1% builder, based on the total weight of the composition. Liquid cleaning compositions may comprise up to about 10% builder, and in some examples, up to about 8% builder, of the total weight of the composition. Granular cleaning compositions may comprise up to about 30% builder, and in some examples, up to about 5% builder, by weight of the composition.

Builders selected from aluminosilicates (e.g., zeolite builders, such as zeolite A, zeolite P, and zeolite MAP) and silicates assist in controlling mineral hardness in wash water, especially calcium and/or magnesium, or to assist in the removal of particulate soils from surfaces. Suitable builders may be selected from the group consisting of phosphates, such as polyphosphates (e.g., sodium tri-polyphosphate), especially sodium salts thereof; carbonates, bicarbonates, sesquicarbonates, and carbonate minerals other than sodium carbonate or sesquicarbonate; organic mono-, di-, tri-, and tetracarboxylates, especially water-soluble nonsurfactant carboxylates in acid, sodium, potassium or alkanolammonium salt form, as well as oligomeric or water-soluble low molecular weight polymer carboxylates including aliphatic and aromatic types; and phytic acid. Additional suitable builders may be selected from citric acid, lactic acid, fatty acid, polycarboxylate builders, for example, copolymers of acrylic acid, copolymers of acrylic acid and maleic acid, and copolymers of acrylic acid and/or maleic acid, and other suitable ethylenic monomers with various types of additional functionalities. Also suitable for use as builders herein are synthesized crystalline ion exchange materials or hydrates thereof having chain structure and a composition represented by the following general anhydride form: $x(M_2O).ySiO_2.zM'O$ wherein M is Na and/or K, M' is Ca and/or Mg; y/x is 0.5 to 2.0; and z/x is 0.005 to 1.0.

Alternatively, the composition may be substantially free of builder.

Structurant/Thickeners i. Bacterial Cellulose

The fluid detergent composition may also comprise from about 0.005% to about 1% by weight of a bacterial cellulose network. The term "bacterial cellulose" encompasses any type of cellulose produced via fermentation of a bacteria of the genus *Acetobacter* such as CELLULON® by CPKelco U.S. and includes materials referred to popularly as microfibrillated cellulose, reticulated bacterial cellulose, and the like. In one aspect, said fibres have cross sectional dimensions of 1.6 nm to 3.2 nm by 5.8 nm to 133 nm. Additionally, the bacterial cellulose fibres have an average microfibre length of at least about 100 nm, or from about 100 to about 1,500 nm. In one aspect, the bacterial cellulose microfibres have an aspect ratio, meaning the average microfibre length divided by the widest cross sectional microfibre width, of from about 100:1 to about 400:1, or even from about 200:1 to about 300:1.

ii. Coated Bacterial Cellulose

The bacterial cellulose may be at least partially coated with a polymeric thickener. The at least partially coated bacterial cellulose may comprise from about 0.1% to about 5%, or even from about 0.5% to about 3%, by weight of bacterial cellulose; and from about 10% to about 90% by weight of the polymeric thickener. Suitable bacterial cellulose may include the bacterial cellulose described above and suitable polymeric thickeners include: carboxymethylcellulose, cationic hydroxymethylcellulose, and mixtures thereof.

iii. Cellulose Fibers Non-Bacterial Cellulose Derived

The composition may further comprise from about 0.01 to about 5% by weight of the composition of a cellulosic fiber. Said cellulosic fiber may be extracted from vegetables, fruits or wood. Commercially available examples are Avicel® from FMC, Citri-Fi from Fiberstar or Betafib from Cosun.

iv. Non-Polymeric Crystalline Hydroxyl-Functional Materials

The composition may further comprise from about 0.01 to about 1% by weight of the composition of a non-polymeric crystalline, hydroxyl functional structurant. Said non-polymeric crystalline, hydroxyl functional structurants generally may comprise a crystallizable glyceride which can be pre-emulsified to aid dispersion into the final fluid detergent composition. Crystallizable glycerides may include hydrogenated castor oil or "HCO" or derivatives thereof, provided that it is capable of crystallizing in the liquid detergent composition.

v. Polymeric Structuring Agents

Fluid detergent compositions of the present invention may comprise from about 0.01% to about 5% by weight of a naturally derived and/or synthetic polymeric structurant. Examples of naturally derived polymeric structurants of use in the present invention include: hydroxyethyl cellulose, hydrophobically modified hydroxyethyl cellulose, carboxymethyl cellulose, polysaccharide derivatives and mixtures thereof. Suitable polysaccharide derivatives include: pectine, alginate, arabinogalactan (gum Arabic), carrageenan, gellan gum, xanthan gum, guar gum and mixtures thereof. Examples of synthetic polymeric structurants of use in the present invention include: polycarboxylates, polyacrylates, hydrophobically modified ethoxylated urethanes, hydrophobically modified non-ionic polyols and mixtures thereof. Said polycarboxylate polymer may be a polyacrylate, polymethacrylate or mixtures thereof. The polyacrylate may be a copolymer of unsaturated mono- or di-carbonic acid and $C_1$-$C_{30}$ alkyl ester of the (meth)acrylic acid. Said copolymers are available from Noveon Inc. under the tradename Carbopol Aqua 30.

Cellulosic Polymer—

The consumer products of the present invention may also include one or more cellulosic polymers including those selected from alkyl cellulose, alkyl alkoxyalkyl cellulose, carboxyalkyl cellulose, alkyl carboxyalkyl cellulose. The cellulosic polymers may be selected from the group comprising carboxymethyl cellulose, methyl cellulose, methyl hydroxyethyl cellulose, methyl carboxymethyl cellulose, and mixtures thereof. The carboxymethyl cellulose may have a degree of carboxymethyl substitution from 0.5 to 0.9 and a molecular weight from 100,000 Da to 300,000 Da.

Bleaching Agents—

The detergent compositions of the present invention may comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the detergent compositions of the present invention may comprise from about 0.1% to about 50% or even from about 0.1% to about 25% bleaching agent by weight of the detergent composition.

Bleach Catalysts—

The detergent compositions of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and mixtures thereof.

Brighteners

Optical brighteners or other brightening or whitening agents may be incorporated at levels of from about 0.01% to about 1.2%, by weight of the composition, into the cleaning compositions described herein. Commercial fluorescent brighteners suitable for the present invention can be classified into subgroups, including but not limited to: derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents.

Water-Soluble Film

The compositions of the present invention may also be encapsulated within a water-soluble film. Preferred film materials are preferably polymeric materials. The film material can, for example, be obtained by casting, blow-molding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material.

Most preferred polymers materials are PVA films known under the MonoSol trade reference M8630, M8900, H8779.

Fabric Hueing Agents

The composition may comprise a fabric hueing agent (sometimes referred to as shading, bluing or whitening agents). Typically, the hueing agent provides a blue or violet shade to fabric. Hueing agents can be used either alone or in combination to create a specific shade of hueing and/or to shade different fabric types. This may be provided for example by mixing a red and green-blue dye to yield a blue or violet shade. Hueing agents may be selected from any known chemical class of dye, including but not limited to acridine, anthraquinone (including polycyclic quinones), azine, azo (e.g., monoazo, disazo, trisazo, tetrakisazo, polyazo), including premetallized azo, benzodifurane and benzodifuranone, carotenoid, coumarin, cyanine, diazahemicyanine, diphenylmethane, formazan, hemicyanine, indigoids, methane, naphthalimides, naphthoquinone, nitro and nitroso, oxazine, phthalocyanine, pyrazoles, stilbene, styryl, triarylmethane, triphenylmethane, xanthenes and mixtures thereof.

Suitable fabric hueing agents include dyes, dye-clay conjugates, and organic and inorganic pigments. Suitable dyes include small molecule dyes and polymeric dyes. Suitable small molecule dyes include small molecule dyes selected from the group consisting of dyes falling into the Colour Index (C.I.) classifications of Direct, Basic, Reactive or hydrolysed Reactive, Solvent or Disperse dyes for example that are classified as Blue, Violet, Red, Green or Black, and provide the desired shade either alone or in combination. Suitable polymeric dyes include polymeric dyes selected from the group consisting of polymers containing covalently bound (sometimes referred to as conjugated) chromogens, (dye-polymer conjugates), for example polymers with chromogens co-polymerized into the backbone of the polymer and mixtures thereof.

Suitable dye clay conjugates include dye clay conjugates selected from the group comprising at least one cationic/basic dye and a smectite clay, and mixtures thereof. Suitable pigments include pigments selected from the group consisting of flavanthrone, indanthrone, chlorinated indanthrone containing from 1 to 4 chlorine atoms, pyranthrone, dichloropyranthrone, monobromodichloropyranthrone, dibromodichloropyranthrone, tetrabromopyranthrone, perylene-3,4,9,10-tetracarboxylic acid diimide, wherein the imide groups may be unsubstituted or substituted by $C_1$-$C_3$-alkyl or a phenyl or heterocyclic radical, and wherein the phenyl and heterocyclic radicals may additionally carry substituents which do not confer solubility in water, anthrapyrimidinecarboxylic acid amides, violanthrone, isoviolanthrone, dioxazine pigments, copper phthalocyanine which may contain up to 2 chlorine atoms per molecule, polychloro-copper phthalocyanine or polybromochloro-copper phthalocyanine containing up to 14 bromine atoms per molecule and mixtures thereof.

The aforementioned fabric hueing agents can be used in combination (any mixture of fabric hueing agents can be used).

Dispersed Perfume

The composition of the present invention may comprise a dispersed perfume composition. By dispersed perfume we herein mean a perfume composition that is freely dispersed in the fabric softener composition and is not encapsulated. A perfume composition comprises one or more perfume raw materials. Perfume raw materials are the individual chemical compounds that are used to make a perfume composition. The choice of type and number of perfume raw materials is dependent upon the final desired scent. In the context of the present invention, any suitable perfume composition may be used. Those skilled in the art will recognize suitable compatible perfume raw materials for use in the perfume composition, and will know how to select combinations of ingredients to achieve desired scents.

Preferably, the level of dispersed perfume is at a level of from 0.1% to 10%, preferably 0.3% to 7.5%, more preferably from 0.5% to 5.0% by total weight of the composition.

The perfume composition may comprise from 2.5% to 30%, preferably from 5% to 30% by total weight of perfume composition of perfume raw materials characterized by a log P lower than 3.0, and a boiling point lower than 250° C.

The perfume composition may comprise from 5% to 30%, preferably from 7% to 25% by total weight of perfume composition of perfume raw materials characterized by having a log P lower than 3.0 and a boiling point higher than 250° C. The perfume composition may comprise from 35% to 60%, preferably from 40% to 55% by total weight of perfume composition of perfume raw materials characterized by having a log P higher than 3.0 and a boiling point lower than 250° C. The perfume composition may comprise from 10% to 45%, preferably from 12% to 40% by total weight of perfume composition of perfume raw materials characterized by having a log P higher than 3.0 and a boiling point higher than 250° C.

Perfume Delivery Technologies

The consumer products may comprise one or more perfume delivery technologies that stabilize and enhance the deposition and release of perfume ingredients from treated substrate. Such perfume delivery technologies can also be used to increase the longevity of perfume release from the treated substrate. Perfume delivery technologies, methods of making certain perfume delivery technologies and the uses of such perfume delivery technologies are disclosed in US 2007/0275866 A1.

The fluid fabric enhancer composition may comprise from about 0.001% to about 20%, or from about 0.01% to about 10%, or from about 0.05% to about 5%, or even from about 0.1% to about 0.5% by weight of the perfume delivery technology. Said perfume delivery technologies may be selected from the group consisting of: perfume capsules, pro-perfumes, polymer particles, functionalized silicones, polymer assisted delivery, molecule assisted delivery, fiber assisted delivery, amine assisted delivery, cyclodextrins, starch encapsulated accord, zeolite and inorganic carrier, and mixtures thereof.

Said perfume delivery technology may comprise microcapsules formed by at least partially surrounding a perfume with a wall material. The capsule wall material may comprise: melamine, polyacrylamide, silicones, silica, polystyrene, polyurea, polyurethanes, polyacrylate based materials, polyacrylate esters based materials, gelatin, styrene malic anhydride, polyamides, aromatic alcohols, polyvinyl alcohol and mixtures thereof. Said melamine wall material may comprise melamine crosslinked with formaldehyde, melamine-dimethoxyethanol crosslinked with formaldehyde, and mixtures thereof. Said polyacrylate based wall materials may comprise polyacrylate formed from methylmethacrylate/dimethylaminomethyl methacrylate, polyacrylate formed from amine acrylate and/or methacrylate and strong acid, polyacrylate formed from carboxylic acid acrylate and/or methacrylate monomer and strong base, polyacrylate formed from an amine acrylate and/or methacrylate monomer and a carboxylic acid acrylate and/or carboxylic acid methacrylate monomer, and mixtures thereof.

Said polyurea based wall material may comprise a polyisocyanate. The polyisocyanate may be an aromatic polyisocyanate containing a phenyl, a toluoyl, a xylyl, a naphthyl or a diphenyl moiety (e.g., a polyisocyanurate of toluene diisocyanate, a trimethylol propane-adduct of toluene diisocyanate or a trimethylol propane-adduct of xylylene diisocyanate), an aliphatic polyisocyanate (e.g., a trimer of hexamethylene diisocyanate, a trimer of isophorone diisocyanate and a biuret of hexamethylene diisocyanate), or a mixture thereof (e.g., a mixture of a biuret of hexamethylene diisocyanate and a trimethylol propane-adduct of xylylene diisocyanate). The polyisocyante may be cross-linked, the cross-linking agent being a polyanine (e.g., diethylenetriamine, bis(3-aminopropyl)amine, bis(hexanethylene)triamine, tris(2-aminoethyl)amine, triethylenetetranine, N,N-bis(-aminopropyl)-1,3-propanediamine, tetraethylenepentamine, pentaethylenehexamine, branched polyethylenimine, chitosan, nisin, gelatin, 1,3-diaminoguanidine monohydrochloride, 1,1-dimethylbiguanide hydrochloride, or guanidine carbonate).

Said polyvinyl alcohol based wall material may comprise a crosslinked, hydrophobically modified polyvinyl alcohol, which comprises a crosslinking agent comprising i) a first dextran aldehyde having a molecular weight of from 2,000 to 50,000 Da; and ii) a second dextran aldehyde having a molecular weight of from greater than 50,000 to 2,000,000 Da.

The perfume capsule may be coated with a deposition aid, a cationic polymer, a non-ionic polymer, an anionic polymer, or mixtures thereof. Suitable polymers may be selected from the group consisting of: polyvinylformaldehyde, partially hydroxylated polyvinylformaldehyde, polyvinylamine, polyethyleneimine, ethoxylated polyethyleneimine, polyvinylalcohol, polyacrylates, and combinations thereof. One or more types of microcapsules, for examples two microcapsules types, wherein one of the first or second microcapsules (a) has a wall made of a different wall material than the other (b) has a wall that includes a different amount of wall material or monomer than the other; or (c) contains a different amount perfume oil ingredient than the other; or (d) contains a different perfume oil, may be used.

Said perfume delivery technology may comprise an amine compound (ARP) or a thio compound. One may also use "reactive" polymeric amines and or polymeric thios in which the amine and/or thio functionality is pre-reacted with one or more perfume raw materials (PRMs) to form a compound. Typically, the reactive amines are primary and/or secondary amines, and may be part of a polymer or a monomer (non-polymer). Such ARPs may also be mixed with additional PRMs to provide benefits of polymer-assisted delivery and/or amine-assisted delivery. Nonlimiting examples of polymeric amines include polymers based on polyalkylimines, such as polyethyleneimine (PEI), or polyvinylamine (PVAm). Nonlimiting examples of monomeric (non-polymeric) amines include hydroxyl amines, such as 2-aminoethanol and its alkyl substituted derivatives, and aromatic amines such as anthranilates. The ARPs may be premixed with perfume or added separately in leave-on or rinse-off applications. A material that contains a heteroatom other than nitrogen and/or sulfur, for example oxygen, phosphorus or selenium, may be used as an alternative to amine compounds. A single molecule may comprise an amine moiety and one or more of the alternative heteroatom moieties, for example, thiols, phosphines and selenols. The benefit may include improved delivery of perfume as well as controlled perfume release.

Dye Transfer Inhibiting Agents

Fabric cleaning compositions may also include one or more materials effective for inhibiting the transfer of dyes from one fabric to another during the cleaning process. Generally, such dye transfer inhibiting agents may include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents may be used at a concentration of about 0.0001% to about 10%, by weight of the composition, in some examples, from about 0.01% to about 5%, by weight of the composition, preferably from about 0.05% to about 2% by weight of the composition.

Chelating Agents

The detergent compositions described herein may also contain one or more metal ion chelating agents. Suitable molecules include copper, iron and/or manganese chelating agents and mixtures thereof. Such chelating agents can be selected from the group consisting of phosphonates, amino carboxylates, amino phosphonates, succinates, polyfunctionally-substituted aromatic chelating agents, 2-pyridinol-N-oxide compounds, hydroxamic acids, carboxymethyl inulins and mixtures thereof. Chelating agents can be present in the acid or salt form including alkali metal, ammonium, and substituted ammonium salts thereof, and mixtures thereof.

Aminocarboxylates useful as chelating agents include, but are not limited to ethylenediaminetetracetates (EDTA); N-(hydroxyethyl)ethylenediaminetriacetates (HEDTA); nitrilotriacetates (NTA); ethylenediamine tetraproprionates; triethylenetetraaminehexacetates, diethylenetriamine-pentaacetates (DTPA); methylglycinediacetic acid (MGDA); Glutamic acid diacetic acid (GLDA); ethanoldiglycines; triethylenetetraaminehexaacetic acid (TTHA); N-hydroxyethyliminodiacetic acid (HEIDA); dihydroxyethylglycine (DHEG); ethylenediaminetetrapropionic acid (EDTP) and derivatives thereof.

Phosphorus containing chelants include, but are not limited to diethylene triamine penta (methylene phosphonic acid) (DTPMP CAS 15827-60-8); ethylene diamine tetra (methylene phosphonic acid) (EDTMP CAS 1429-50-1); 2-Phosphonobutane 1,2,4-tricarboxylic acid (Bayhibit® AM); hexamethylene diamine tetra(methylene phosphonic acid) (CAS 56744-47-9); hydroxy-ethane diphosphonic acid (HEDP CAS 2809-21-4); hydroxyethane dimethylene phosphonic acid; 2-phosphono- 1,2,4-Butanetricarboxylic acid (CAS 37971-36-1); 2-hydroxy-2-phosphono-Acetic acid (CAS 23783-26-8); Aminotri(methylenephosphonic acid) (ATMP CAS 6419-19-8); P,P'-(1,2-ethanediyl)bis-Phosphonic acid (CAS 6145-31-9); P,P'-methylenebis-Phosphonic acid (CAS 1984-15-2); Triethylenediaminetetra(methylene phosphonic acid) (CAS 28444-52-2); P-(1-hydroxy-1-methylethyl)-Phosphonic acid (CAS 4167-10-6); bis(hexamethylene triamine penta(methylenephosphonic acid)) (CAS 34690-00-1); N2,N2,N6,N6-tetrakis(phosphonomethyl)-Lysine (CAS 194933-56-7, CAS 172780-03-9), salts thereof, and mixtures thereof. Preferably, these aminophosphonates do not contain alkyl or alkenyl groups with more than about 6 carbon atoms.

A biodegradable chelator that may also be used herein is ethylenediamine disuccinate ("EDDS"). The trisodium salt of EDDA may be used, though other forms, such as magnesium salts, may also be useful. Polymeric chelants such as Trilon P® from BASF may also be useful.

Polyfunctionally-substituted aromatic chelating agents may also be used in the cleaning compositions. Compounds of this type in acid form are dihydroxydisulfobenzenes, such as 1,2-dihydroxy-3,5-disulfobenzene, also known as Tiron. Other sulphonated catechols may also be used. In addition to the disulfonic acid, the term "tiron" may also include mono- or di-sulfonate salts of the acid, such as, for example, the disodium sulfonate salt, which shares the same core molecular structure with the disulfonic acid.

Other suitable chelating agents for use herein are the commercial DEQUEST series, and chelants from Monsanto, Akzo-Nobel, DuPont, Dow, the Trilon® series from BASF and Nalco.

The chelant may be present in the detergent compositions disclosed herein at from about 0.005% to about 15% by weight, about 0.01% to about 5% by weight, about 0.1% to about 3.0% by weight, or from about 0.2% to about 0.7% by weight, or from about 0.3% to about 0.6% by weight of the detergent compositions disclosed herein.

Hygiene and Malodor

The compositions of the present invention may also comprise one or more of zinc ricinoleate, thymol, quaternary ammonium salts such as Bardac®, polyethylenimines (such as Lupasol® from BASF) and zinc complexes thereof, silver and silver compounds, especially those designed to slowly release $Ag^+$ or nano-silver dispersions.

Fillers and Carriers

Fillers and carriers may be used in the cleaning compositions described herein. As used herein, the terms "filler" and "carrier" have the same meaning and can be used interchangeably.

Liquid cleaning compositions and other forms of cleaning compositions that include a liquid component (such as liquid-containing unit dose cleaning compositions) may contain water and other solvents as fillers or carriers. Suitable solvents also include lipophilic fluids, including siloxanes, other silicones, hydrocarbons, glycol ethers, glycerine derivatives such as glycerine ethers, perfluorinated amines, perfluorinated and hydrofluoroether solvents, low-volatility nonfluorinated organic solvents, diol solvents, and mixtures thereof.

Low molecular weight primary or secondary alcohols exemplified by methanol, ethanol, propanol, and isopropanol are suitable. Monohydric alcohols may be used in some examples for solubilizing surfactants, and polyols such as those containing from 2 to about 6 carbon atoms and from 2 to about 6 hydroxy groups (e.g., 1,3-propanediol, ethylene glycol, glycerine, and 1,2-propanediol) may also be used. Amine-containing solvents, such as monoethanolamine, diethanolamine and triethanolamine, may also be used.

The cleaning compositions may contain from about 5% to about 90%, and in some examples, from about 10% to about 50%, by weight of the composition, of such carriers. For compact or super-compact heavy duty liquid or other forms of cleaning compositions, the use of water may be lower than about 40% by weight of the composition, or lower than about 20%, or lower than about 5%, or less than about 4% free water, or less than about 3% free water, or less than about 2% free water, or substantially free of free water (i.e., anhydrous).

For powder or bar cleaning compositions, or forms that include a solid or powder component (such as powder-containing unit dose cleaning composition), suitable fillers may include, but are not limited to, sodium sulfate, sodium chloride, clay, or other inert solid ingredients.

For either compacted or supercompacted liquid or powder cleaning compositions, or other forms, the level of liquid or solid filler in the product may be reduced, such that either the same amount of active chemistry is delivered to the wash liquor as compared to noncompacted cleaning compositions, or in some examples, the cleaning composition is more efficient such that less active chemistry is delivered to the wash liquor as compared to noncompacted compositions.

The wash liquor may be formed by contacting the cleaning composition to water in such an amount so that the concentration of cleaning composition in the wash liquor is from above 0 g/l to 6 g/l. In some examples, the concentration may be from about 0.5 g/l to about 5 g/l, or to about 3.0 g/l, or to about 2.5 g/l, or to about 2.0 g/l, or to about 1.5 g/l, or from about 0 g/l to about 1.0 g/l, or from about 0 g/l to about 0.5 g/l. These dosages are not intended to be limiting, and other dosages may be used that will be apparent to those of ordinary skill in the art.

Buffer System

The cleaning compositions described herein may be formulated such that, during use in aqueous cleaning operations, the wash water will have a pH of between about 3.0 and about 11.5, and in some examples, between about 5.0 and about 10. Techniques for controlling pH at recommended usage levels include the use of buffers, alkalis, or acids, and are well known to those skilled in the art. These include, but are not limited to, the use of sodium carbonate, citric acid or sodium citrate, lactic acid or lactate, monoethanol amine or other amines, boric acid or borates, and other pH-adjusting compounds well known in the art.

EXAMPLES

Preparation Examples, Comparative Preparation Examples, Examples, and Comparative Examples, are provided below. Incidentally, the amount of each component in Table 1 is an amount in terms of the pure material unless otherwise noted. In the following examples, "parts" means parts by mass, and "%" means % by mass.

It is to be noted that the MQ resin used in the following examples had a $(CH_3)_3SiO_{1/2}$ unit as the M unit and an $SiO_2$ unit as the Q unit.

Preparation Example 1

The following components were stirred with a homomixer at 1,000 rpm until the silica had dispersed sufficiently to give an antifoaming composition:

(A) organopolysiloxane (viscosity: 900 $mm^2/s$) having the following structure — 80 parts

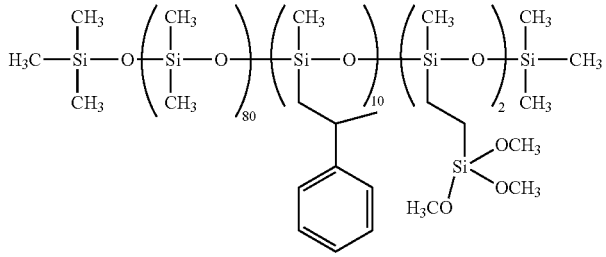

(B) MQ resin (M/Q = 0.6) — 8 parts (C) silica (Sipernat D10, Evonik Industries, specific surface area: 90 $m^2/g$, particle particle size: 6.5 □ m) — 12 parts.

Preparation Example 2

The following components were stirred with a homomixer at 2,000 rpm until the silica had dispersed sufficiently to give an antifoaming composition:

(A) organopolysiloxane (viscosity: 17,000 $mm^2/s$) having the following structure — 70 parts -continued

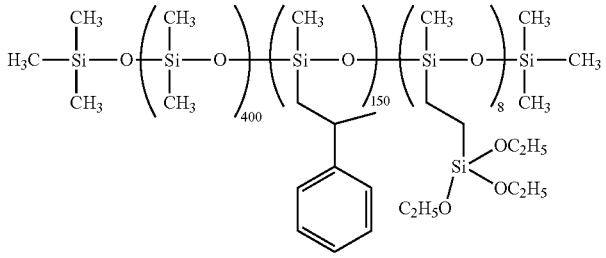

| | | |
|---|---|---|
| (B) | MQ resin (M/Q = 0.75) | 5 parts |
| (C) | silica (Sipernat D10, Evonik Industries) | 10 parts |
| (D) | ethyl laurate | 15 parts. |

Preparation Example 3

The following components were stirred with a homomixer at 2,000 rpm until the silica had dispersed sufficiently to give an antifoaming composition:

(A) organopolysiloxane (viscosity: 1,800 $mm^2/s$) having the following structure 60 parts

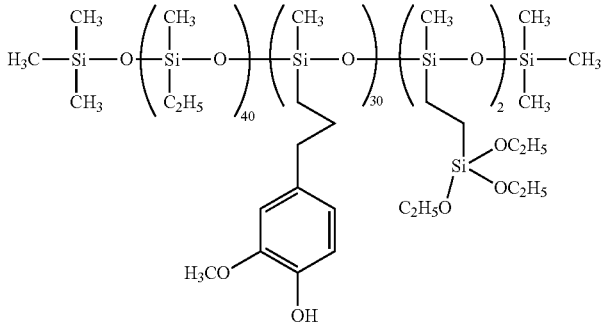

(B) MQ resin (M/Q = 0.6) 15 parts
(C) silica (Sipernat D13, Evonik Industries, specific surface area: 110 $m^2/g$,
particle size: 10.5 ▭ m) 15 parts
(D) octyl stearate 10 parts.

Preparation Example 4

The antifoaming composition obtained in Preparation Example 1 was heated at 80° C. for 2 hours to give an antifoaming composition.

Preparation Example 5

To the antifoaming composition obtained in Preparation Example 2, 0.1 parts of potassium hydroxide was added. This was heated at 140° C. for 3 hours to give an antifoaming composition.

Comparative Preparation Example 1

The following components were stirred with a homomixer at 1,000 rppm until the silica had dispersed sufficiently to give an antifoaming composition:

(A) organopolysiloxane (viscosity: 900 $mm^2/s$) having the following structure 80 parts -continued

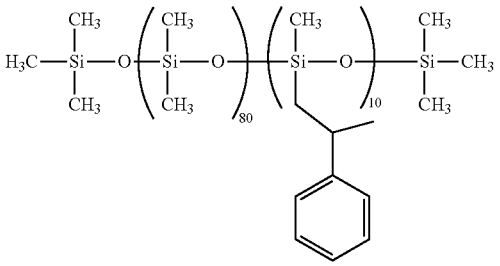

| | | |
|---|---|---|
| (B) | MQ resin (M/Q = 0.6) | 8 parts |
| (C) | silica (Sipemat D10, Evonik Industries) | 12 parts. |

Comparative Preparation Example 2

The following components were stirred with a homomixer at 2,000 rpm until the silica had dispersed sufficiently to give an antifoaming composition:

(A) organopolysiloxane (viscosity: 2,000 $mm^2/s$) having the following structure — 60 parts

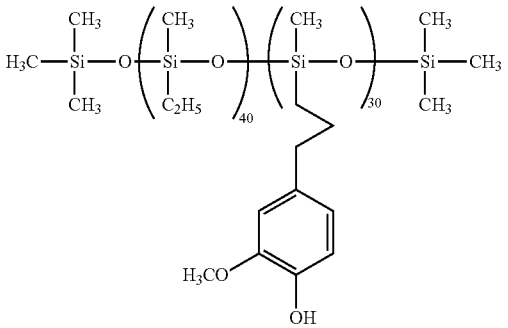

(B) MQ resin (M/Q = 0.6) — 15 parts (C) silica (Sipernat D13, Evonik Industries) — 15 parts (D) octyl stearate — 10 parts.

(*2) Detergent composition B: 10% of monoethanolamine lauryl ether sulfate, 15% of monoethanolamine dodecylbenzenesulfonate, 10% of sodium laurate, and 65% of water.

(*3) Detergent composition C: 10% of lauryl alcohol ethoxylate, 15% of sodium dodecylbenzenesulfonate, 0.5% of alkylamine oxide, and 74.5% of water.

Subsequently, the obtained detergent composition containing an antifoaming agent was introduced into a glass bottle and stored in a thermostat at 40 □C, and the change of appearance after 2 weeks was observed and evaluated as follows: no change: good, slight precipitation or separation: fair, apparent precipitation or separation: bad.

Evaluation Test of Antifoaming Properties

Into a glass bottle, 0.16 parts of each detergent composition containing an antifoaming agent, 40 parts of tap water with the hardness of 80, and 1 g of cotton cloth were introduced. This was shaken with a vertical shaker (manufactured by YAYOI. CO., LTD) for 40 minutes. Then, the height of the foam was measured to determine the antifoaming properties (suds suppressing performance).

These results are shown in Table 1.

TABLE 1

| | | Examples | | | | | Comparative Examples | | | | |
|---|---|---|---|---|---|---|---|---|---|---|---|
| | Components (parts by mass) | 1 | 2 | 3 | 4 | 5 | 1 | 2 | 3 | 4 | 5 |
| 1 | Antifoaming composition of Preparation Example 1 | 0.5 | | | | | | | | | |
| 2 | Antifoaming composition of Preparation Example 2 | | 1.0 | | | | | | | | |
| 3 | Antifoaming composition of Preparation Example 3 | | | 0.5 | | | | | | | |
| 4 | Antifoaming composition of Preparation Example 4 | | | | 0.5 | | | | | | |
| 5 | Antifoaming composition of Preparation Example 5 | | | | | 1.0 | | | | | |
| 6 | Antifoaming composition of Comparative Preparation | | | | | | 0.5 | | | 1.0 | |
| 7 | Antifoaming composition of Comparative Preparation | | | | | | | 0.5 | | | |
| 8 | Antifoaming composition of Comparative Preparation | | | | | | | | 0.5 | | 1.0 |
| 9 | Detergent composition A | 99.5 | | | 99.5 | | 99.5 | | 99.5 | | |
| 10 | Detergent comoosition B | | 99.0 | | | 99.0 | | | | 99.0 | |
| 11 | Detergent composition C | | | 99.5 | | | | 99.5 | | | 99.0 |
| Evaluation | Stability of appearance (after 2 weeks) | fair | good | good | good | fair | fair | bad | fair | bad | bad |
| | Height of foam/mm | 4.5 | 4.0 | 5.0 | 4.2 | 3.8 | 6.7 | 8.5 | 5.6 | 6.1 | 5.7 |

Comparative Preparation Example 3

The antifoaming composition obtained in Comparative Preparation Example 1 was heated at 80° C. for 2 hours to give an antifoaming composition.

Examples 1 to 5, Comparative Examples 1 to 5

Stability Test

To the following Detergent composition A (*1), Detergent composition B (*2), and Detergent composition C (*3), 0.5% or 1% of each antifoaming composition was added. This was stirred with a homomixer at 2,000 rpm for 30 seconds to give a detergent composition containing an antifoaming agent.

(*1) Detergent composition A: 10% of sodium lauryl ether sulfate, 7% of sodium dodecylbenzenesulfonate, 5% of sodium tripolyphosphate, and 78% of water.

On the basis of the results of the stability test and the evaluation of antifoaming properties in Examples 1 to 5 and Comparative Examples 1 to 5, it was confirmed that the detergent composition using the inventive antifoaming composition formed a more stable detergent composition and could control foam more effectively.

Example 6: Liquid Detergent Fabric Care Compositions

Liquid detergent fabric care compositions 6A-6E are made by mixing together the ingredients listed in the proportions shown:

| Ingredient (wt %) | 6A | 6B | 6C | 6D | 6E |
|---|---|---|---|---|---|
| $C_{12}$-$C_{15}$ alkyl polyethoxylate (1.8) sulfate[1] | 20.1 | 16.6 | 14.7 | 13.9 | 8.2 |
| $C_{11.8}$ linear alkylbenzene sulfone acid[2] | — | 4.9 | 4.3 | 4.1 | 8.2 |
| $C_{16}$-$C_{17}$ branched alkyl sulfate[1] | — | 2.0 | 1.8 | 1.6 | — |
| $C_{12}$ alkyl trimethyl ammonium chloride[4] | 2.0 | | — | — | — |
| $C_{12}$ alkyl dimethyl amine oxide[5] | | 0.7 | 0.6 | — | — |
| $C_{12}$-$C_{14}$ alcohol 9 ethoxylate[3] | 0.3 | 0.8 | 0.9 | 0.6 | 0.7 |
| $C_{15}$-$C_{16}$ branched alcohol -7 ethoxylate [1] | — | — | — | — | 4.6 |
| 1,2 Propane diol[6] | 4.5 | 4.0 | 3.9 | 3.1 | 2.3 |
| Ethanol | 3.4 | 2.3 | 2.0 | 1.9 | 1.2 |
| $C_{12}$-$C_{18}$ Fatty Acid[5] | 2.1 | 1.7 | 1.5 | 1.4 | 3.2 |
| Citric acid[7] | 3.4 | 3.2 | 3.5 | 2.7 | 3.9 |
| Protease[7] (32 g/L) | 0.42 | 1.3 | 0.07 | 0.5 | 1.12 |
| Fluorescent Whitening Agent[8] | 0.08 | 0.2 | 0.2 | 0.17 | 0.18 |
| Diethylenetriamine pentaacetic acid[6] | 0.5 | 0.3 | 0.3 | 0.3 | 0.2 |
| Ethoxylated polyamine[9] | 0.7 | 1.8 | 1.5 | 2.0 | 1.9 |
| Grease Cleaning Alkoxylated Polyalkylenimine Polymer[10] | — | — | 1.3 | 1.8 | — |
| Zwitterionic ethoxylated quaternized sulfated hexamethylene diamine[11] | — | 1.5 | — | — | 0.8 |
| Hydrogenated castor oil[12] | 0.2 | 0.2 | | 0.12 | 0.3 |
| Copolymer of acrylamide and methacrylamidopropyl trimethylammonium chloride[13] | 0.3 | 0.2 | 0.3 | 0.1 | 0.3 |
| Antifoam of any of Preparation Examples 1-5 (mixtures thereof may also be used) | 0.2 | 0.1 | 0.2 | 0.2 | 0.2 |
| Water, perfumes, dyes, buffers, solvents and other optional components | to 100% pH 8.0-8.2 | to 100% pH 8.0-8.2 | to 100% pH 8.0-8.2 | to 100% pH 8.0-8.2 | to 100% pH 8.0-8.2 |

Example 7: Liquid or Gel Detergents

Liquid or gel detergent fabric care compositions 7A-7E are prepared by mixing the ingredients listed in the proportions shown:

| Ingredient (wt %) | 7A | 7B | 7C | 7D | 7E | 7F | 7G |
|---|---|---|---|---|---|---|---|
| $C_{12}$-$C_{15}$ alkyl polyethoxylate (3.0) sulfate[1] | 8.5 | 2.9 | 2.9 | 2.9 | 6.8 | 9.1 | 9.1 |
| $C_{11.8}$ linear alkylbenzene sulfonic acid[2] | 11.4 | 8.2 | 8.2 | 8.2 | 1.2 | 5.7 | 5.7 |
| $C_{14}$-$C_{15}$ alkyl 7-ethoxylate[1] | — | 5.4 | 5.4 | 5.4 | 3.0 | | |
| $C_{12}$-$C_{14}$ alkyl 7-ethoxylate[3] | 7.6 | — | — | — | 1.0 | 0.2 | 0.2 |
| $C_{12}$ alkyl dimethyl amine oxide[5] | | | | | | 0.6 | 0.6 |
| 1,2 Propane diol | 6.0 | 1.3 | 1.3 | 6.0 | 0.2 | 0.8 | 0.8 |
| Ethanol | — | 1.3 | 1.3 | — | 1.4 | 0.7 | 0.7 |
| Di Ethylene Glycol | 4.0 | — | — | — | — | | |
| Na Cumene Sulfonate | — | 1.0 | 1.0 | 0.9 | — | 1.1 | 3.1 |
| $C_{12}$-$C_{18}$ Fatty Acid[5] | 9.5 | 3.5 | 3.5 | 3.5 | 4.5 | 0.7 | 0.7 |
| Citric acid | 2.8 | 3.4 | 3.4 | 3.4 | 2.4 | 2.1 | 2.1 |
| Protease (40.6 mg/g/)[7] | 1.0 | 0.6 | 0.6 | 0.6 | 0.3 | | |
| Protease (54.5 mg/g/)[7] | | | | | | 0.3 | 0.3 |
| Natalase 200L (29.26 mg/g)[14] | — | 0.1 | 0.1 | 0.1 | — | | |
| Termamyl Ultra (25.1 mg/g)[14] | 0.7 | 0.1 | 0.1 | 0.1 | 0.1 | 0.1 | 0.1 |
| Mannaway 25L (25 mg/g)[14] | 0.1 | 0.1 | 0.1 | 0.1 | 0.02 | | |
| Whitezyme (20 mg/g)[14] | 0.2 | 0.1 | 0.1 | 0.1 | — | | |
| Fluorescent Whitening Agent[8] | 0.2 | 0.1 | 0.1 | 0.1 | | 0.04 | 0.04 |

-continued

| Ingredient (wt %) | 7A | 7B | 7C | 7D | 7E | 7F | 7G |
|---|---|---|---|---|---|---|---|
| Diethylene Triamine Penta Methylene Phosphonic acid | | 0.3 | 0.3 | 0.3 | 0.1 | | |
| Diethylenetriamine pentaacetic acid[6] | | | | | | 0.4 | 0.4 |
| Hydroxy Ethylidene 1,1 Di Phosphonic acid | 1.5 | — | — | — | — | | |
| Zwitterionic ethoxylated quaternized sulfated hexamethylene diamine[11] | 2.1 | 1.0 | 1.0 | 1.0 | 0.7 | | |
| Grease Cleaning Alkoxylated Polyalkylenimine Polymer[10] | — | 0.4 | 0.4 | 0.4 | — | | 1.5 |
| Ethoxylated polyamine[9] | | | | | | 2.2 | |
| PEG-PVAc Polymer[15] | 0.9 | 0.5 | 0.5 | 0.5 | — | | |
| Hydrogenated castor oil[12] | 0.8 | 0.4 | 0.4 | 0.4 | 0.3 | 0.15 | 0.15 |
| Borate | — | 1.3 | — | — | 1.2 | 1.1 | 1.1 |
| 4 Formyl Phenyl Boronic Acid | — | — | 0.025 | — | — | | |
| Antifoam of any of the Preparation Examples 1-5. | 0.4 | 0.3 | 0.3 | 0.2 | 0.3 | 0.15 | 0.15 |
| Tinosan ® HP 100 via BASF | | | | | | 0.05 | 0.05 |
| Water, solvents, perfumes, dyes, buffers, neutralizers, stabilizers and other optional components | to 100% pH 8.0-8.2 | to 100% pH 8.0-8.2 | to 100% pH 8.0-8.2 | to 100% pH 8.0-8.2 | to 100% pH 8.0-8.2 | to 100% pH 8.0-8.5 | to 100% pH 8.0-8.5 |

[1]Available from Shell Chemicals, Houston, TX.
[2]Available from Huntsman Chemicals, Salt Lake City, UT.
[3]Available from Sasol Chemicals, Johannesburg, South Africa
[4]Available from Evonik Corporation, Hopewell, VA.
[5]Available from The Procter & Gamble Company, Cincinnati, OH.
[6]Available from Sigma Aldrich chemicals, Milwaukee, WI
[7]Available from Genencor International, South San Francisco, CA.
[8]Available from Ciba Specialty Chemicals, High Point, NC
[9]600 g/mol molecular weight polyethylenimine core with 20 ethoxylate groups per —NH and available from BASF (Ludwigshafen, Germany)
[10]600 g/mol molecular weight polyethylenimine core with 24 ethoxylate groups per —NH and 16 propoxylate groups per —NH. Available from BASF (Ludwigshafen, Germany).
[11]Described in WO 01/05874 and available from BASF (Ludwigshafen, Germany)
[12]Available under the trade name Thixin ® R from Elementis Specialties, Highstown, NJ
[13]Available from Nalco Chemicals, Naperville, IL.
[14]Available from Novozymes, Copenhagen, Denmark.
[15]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

Example 8: Rinse-Added Fabric Care Compositions

Rinse-Added fabric care compositions 11A-11D are prepared by mixing together ingredients shown below:

| Ingredient | 8A | 8B | 8C | 8D |
|---|---|---|---|---|
| Fabric Softener Active[1] | 16.2 | 11.0 | 16.2 | — |
| Fabric Softener Active[2] | — | — | — | 5.0 |
| Cationic Starch[3] | 1.5 | — | 1.5 | — |
| Polyethylene imine[4] | 0.25 | 0.25 | — | — |
| Quaternized polyacrylamide[5] | — | | 0.25 | 0.25 |
| Calcium chloride | 0.15 | 0. | 0.15 | — |
| Ammonium chloride | 0.1 | 0.1 | 0.1 | — |
| Antifoam of any of the Preparation Examples 1-5 | 0.1 | 0.1 | 0.1 | 0.1 |
| Perfume | 0.85 | 2.0 | 0.85 | 1.0 |
| Perfume microcapsule[6] | 0.65 | 0.75 | 0.65 | 0.3 |
| Water, suds suppressor, stabilizers, pH control agents, buffers, dyes & other optional ingredients | to 100% pH = 3.0 | to 100% pH = 3.0 | to 100% pH = 3.0 | to 100% pH = 3.0 |

[1]N,N di(tallowoyloxyethyl) - N,N dimethylammonium chloride available from Evonik Corporation, Hopewell, VA.
[2]Reaction product of fatty acid with Methyldiethanolamine, quaternized with Methylchloride, resulting in a 2.5:1 molar mixture of N,N-di(tallowoyloxyethyl) N,N-dimethylammonium chloride and N-(tallowoyloxyethyl) N-hydroxyethyl N,N-dimethylammonium chloride available from Evonik Corporation, Hopewell, VA.
[3]Cationic starch based on common maize starch or potato starch, containing 25% to 95% amylose and a degree of substitution of from 0.02 to 0.09, and having a viscosity measured as Water Fluidity having a value from 50 to 84. Available from National Starch, Bridgewater, NJ.
[4]Available from Nippon Shokubai Company, Tokyo, Japan under the trade name Epomin ® 1050.
[5]Cationic polyacrylamide polymer such as a copolymer of acrylamide-co-[2-(acryloylamino)ethyl]tri-methylammonium chloride (quaternized dimethyl aminoethyl acrylate) available from BASF, AG, Ludwigshafen under the trade name Sedipur ® 544.
[6]Available from Appleton Paper of Appleton, WI

Example 9: Powder Detergent Compositions

| Ingredient | 9A wt % | 9b wt % | 9c wt % |
|---|---|---|---|
| LAS (Non-sulphated anionic surfactant) | 10 | 15-16 | 7 |

-continued

| Ingredient | 9A wt % | 9b wt % | 9c wt % |
|---|---|---|---|
| Mixture of alkyl sulphate surfactants | 1.5 | 1.5-2 | 1.5 |
| Cationic surfactant | 0-1 | 0-1.5 | 0-1 |
| Non ionic surfactant | 0-1 | 0-1.5 | 0-1 |
| Zeolite | 0-3 | 6-10 | 0-3 |
| Polymeric dispersing or soil release agents | 1-3 | 1-4 | 1-3 |
| Bleach and bleach activator | 0-5 | 4-6 | 2-3 |
| Silicate | 7-9 | — | 5-6 |
| Carbonate | 10-30 | 25-35 | 15-30 |
| Sulfate | 30-70 | 30-35 | 40-70 |
| Antifoam of any of the Preparation Examples 1-5 | 0-1.5 | 0-1.5 | 0-1.5 |
| Deionized water | Balance to 100 wt % | | |

The dimensions and values disclosed herein are not to be understood as being strictly limited to the exact numerical values recited. Instead, unless otherwise specified, each such dimension is intended to mean both the recited value and functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A composition comprising an adjunct ingredient and an antifoam, said antifoam comprising:

a) an organopolysiloxane comprising at least one hydrolysable group of formula (1) said at least one hydrolysable group being bound to least one silicon atom of said organopolysiloxane segment composed of the main chain and said main chain containing a siloxy unit of formula (2) in an amount of at least 10 mole % based on weight of the said organopolysiloxane;

(1)

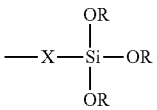

wherein X is a divalent hydrocarbon group comprising 1 to 10 carbon atoms and R is independently a hydrogen atom or a monovalent hydrocarbon group comprising 1 to 4 carbon atoms (2)

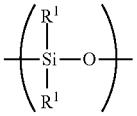

wherein $R^1$ is independently a monovalent hydrocarbon group comprising 1 to 12 carbon atoms and $R^2$ is independently selected from an aryl moiety, a $C_6$-$C_{12}$ alkylaryl moiety, and a $C_6$-$C_{12}$ alkyl moiety, said moieties optionally comprising an oxygen atom or a halogen atom, b) a non-linear organosilicone resin; and c) hydrophobic filler said composition being a laundry detergent and/or fabric enhancer;

wherein the antifoam's organopolysiloxane has formula (3)

(3)

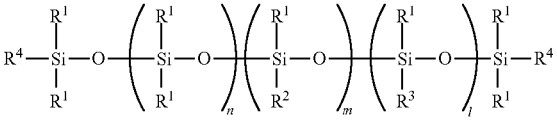

wherein:

a) each $R^1$ is independently a monovalent hydrocarbon group comprising 1 to 12 carbon atoms;

b) each $R^2$ is independently selected from an aryl moiety, a $C_6$-$C_{12}$ alkylaryl moiety, and a $C_6$-$C_{12}$ alkyl moiety, said moieties optionally comprising an oxygen atom or a halogen atom;

c) $R^3$ is a hydrolyzable organic group of the formula (1) below:

(1)

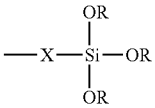

wherein for each $R^3$ X is independently a divalent hydrocarbon group, and for each $R^3$ each R is independently a hydrogen atom or a monovalent hydrocarbon group comprising 1 to 4 carbon atoms;

d) each $R^4$ is independently $R^1$, an organic moiety selected from the group consisting of a hydrolyzable organic moiety of the formula (1), a hydroxy moiety and methoxy moiety, e) n is an integer of 5 to 10,000;

f) m is an integer of 1 to 2000; and g) 1 is an integer of 1 to 20.

2. The composition according to claim 1, wherein the antifoam's non-linear organosilicone resin is a siloxane resin comprising $SiO_{4/2}$ units and $(R^5)_3SiO_{1/2}$ units and each of said unit's $R^5$ is independently selected from the group consisting of a monovalent hydrocarbon group comprising 1 to 10 carbon atoms, hydrocarbonoxy group or hydroxyl group with the proviso that at least 10 mole % of said $R^5$ moieties are monovalent hydrocarbon groups; and the ratio of and $(R^5)_3SiO_{1/2}$ units to $SiO_{4/2}$ units in said siloxane resin is from about 0.4 to about 2.5.

3. The composition according to claim 1, wherein antifoam's non-linear organosilicone resin comprises from about 0.1 to about 30% by the weight of resin of $R^5SiO_{3/2}$ units.

4. The composition according to claim 1 comprising, based on total antifoam weight, a) from about 30% to about 90% of said organopolysiloxane;

b) from about 1% to about 50% of said non-linear organosilicone resin; and/or c) from about 0.5% to about 50% of said hydrophobic filler.

5. The composition according to claim 1 wherein the antifoam further comprises, based on total antifoam weight, from about 0.5% to about 20% of an organic oil.

6. The composition according to according to claim 1 comprising, based on total composition weight, less than 5% of said antifoam.

7. The composition according to claim 1, wherein said antifoam is in a solid form, preferably in a form selected from the group consisting of a powder, an agglomerate, and mixtures thereof.

8. The composition according to claim 1, wherein the adjunct ingredient is selected from the group consisting of surfactants, color care polymers, deposition aids, surfactant boosting polymers, pH adjusters, product color stabilizers, preservatives, solvents, builders, chelating agents, dye transfer inhibiting agents, dispersants, enzymes, and enzyme stabilizers, catalytic materials, bleach, bleach activators, polymeric dispersing agents, clay soil removal/anti-redeposition agents, brighteners, suds suppressors, dyes, UV absorbers, perfume and perfume delivery systems, structure elasticizing agents, thickeners/structurants, fabric softeners, carriers, hydrotropes, oligoamines, processing aids, hueing agents, and/or pigments.

9. A composition according to claim 8 comprising a surfactant selected from the group consisting of anionic surfactant, cationic surfactant, nonionic surfactant, zwitterionic surfactant, ampholytic surfactant and mixtures thereof.

10. A composition according to claim 8 wherein:

a) said fabric softener active is selected from the group consisting of polyglycerol esters, oily sugar derivatives, wax emulsions, fatty acids, N, N-bis(stearoyl-oxy-ethyl) N,N-dimethyl ammonium chloride, N,N-bis (tallowoyl-oxy-ethyl) N,N-dimethyl ammonium chloride, N,N-bis(stearoyl-oxy-ethyl)N-(2 hydroxyethyl)N-methyl ammonium methylsulfate and mixtures thereof;

b) said deposition aid polymer comprises a cationic polymer having a cationic charge of from about 0.005 meq/g to about 23 meq/g at the pH of said composition;

c) said perfume delivery system comprises components selected from the group consisting of a perfume microcapsule, or a moisture-activated perfume microcapsule, wherein the microcapsule comprises a shell comprising a polyacrylate and/or a polymer crosslinked with an aldehyde, a perfume carrier and an encapsulated perfume composition, wherein said perfume carrier may be selected from the group consisting of cyclodextrins, starch microcapsules, porous carrier microcapsules, and mixtures thereof; and wherein said encapsulated perfume composition may comprise low volatile perfume ingredients, high volatile perfume ingredients, and mixtures thereof;

d) said enzyme is selected from the group consisting of protease, amylase, lipase, mannanase, cellulase, xyloglucanase, pectate lyase, and mixtures thereof;

e) said structurant is selected from the group of hydrogenated castor oil; derivatives of hydrogenated castor oil; microfibrillar cellulose; hydroxyfunctional crystalline materials, long-chain fatty alcohols, 12-hydroxystearic acid; clays; and mixtures thereof;

f) said polymeric dispersing agent is selected from the group consisting of polycarboxylates, soil release polymers, carboxymethylcelluloses, poly(vinyl-pyrrolidone), poly (ethylene glycol), poly(vinyl alcohol), poly (vinylpyridine-N-oxide), poly(vinylimidazole), zwitterionic ethoxylated quaternized sulfated hexamethylene diamine, alkoxylated polyalkylenimine, ethoxylated polyamine, polyethylene glycol-polyvinylacetate;

g) said hueing agent is selected from the group consisting of small molecule dyes, polymeric dyes, dye clay conjugates and pigments; and h) said oligoamine is selected from the group consisting of polyetheramines, and i) mixtures thereof.

11. A detergent and/or a fabric enhancer comprising an adjunct ingredient and an antifoam prepared by combining the organopolysiloxane, non-linear organosilicone resin, and hydrophobic filler according to claim 1 to form a mixture and then heat treating said mixture at a temperature from about 50° C. to about 200° C.

12. A detergent and/or a fabric enhancer according to claim 11 wherein the said antifoam preparation comprises combining, before said heat treating step, said organopolysiloxane, said non-linear organosilicone resin, said hydrophobic filler and an alkali substance to form a mixture.

13. A detergent and/or a fabric enhancer according to claim 11 wherein the said antifoam preparation further comprises combining an organic oil with said organopolysiloxane, non-linear organosilicone resin, hydrophobic filler and optionally said alkali substance to form a mixture.

14. A method of treating and/or cleaning a situs, said method comprising a) optionally washing, rinsing and/or drying said situs;

b) contacting said situs with an antifoam composition and/or a consumer according to claim 1; and c) optionally washing, rinsing, and/or drying said situs via passive or active drying.

* * * * *